US011837177B2

(12) United States Patent
Jang et al.

(10) Patent No.: US 11,837,177 B2
(45) **Date of Patent: *Dec. 5, 2023**

(54) DISPLAY APPARATUS AND ELECTRONIC DEVICE INCLUDING THE SAME

(71) Applicant: SAMSUNG DISPLAY CO., LTD., Yongin-si (KR)

(72) Inventors: Sanghee Jang, Yongin-si (KR); Juhoon Kang, Yongin-si (KR); Gunhee Kim, Yongin-si (KR); Hyunho Kim, Yongin-si (KR); Donghwan Shim, Yongin-si (KR); Seungchan Lee, Yongin-si (KR); Joohee Jeon, Yongin-si (KR); Sunyoung Jung, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/045,372

(22) Filed: Oct. 10, 2022

(65) Prior Publication Data

US 2023/0055922 A1 Feb. 23, 2023

Related U.S. Application Data

(63) Continuation of application No. 17/450,257, filed on Oct. 7, 2021, now Pat. No. 11,468,848.

(30) Foreign Application Priority Data

Nov. 2, 2020 (KR) ..... 10-2020-0144587

(51) Int. Cl.
*G09G 3/3275* (2016.01)
*G09G 3/3266* (2016.01)

(52) U.S. Cl.
CPC ..... *G09G 3/3275* (2013.01); *G09G 3/3266* (2013.01); *G09G 2310/08* (2013.01)

(58) Field of Classification Search
None
See application file for complete search history.

(56) References Cited

U.S. PATENT DOCUMENTS

2018/0366586 A1 12/2018 Son et al.
2020/0052048 A1* 2/2020 Kuo ..... G06F 1/1605

FOREIGN PATENT DOCUMENTS

CN 110047897 A 7/2019
CN 111048041 A 4/2020
(Continued)

*Primary Examiner* — Christopher J Kohlman
(74) *Attorney, Agent, or Firm* — Lewis Roca Rothgerber Christie LLP

(57) ABSTRACT

A display apparatus includes: a plurality of first display elements at a first display area; a plurality of first pixel circuits at the first display area, and electrically connected to the plurality of first display elements, respectively; a plurality of second display elements at a second display area; a plurality of second pixel circuits located along a first direction at a non-display area, and electrically connected to the plurality of second display elements, respectively; and a data line electrically connected to at least one first pixel circuit from among the plurality of first pixel circuits that is located along a second direction crossing the first direction at the first display area, and to at least one second pixel circuit from among the plurality of second pixel circuits. The plurality of second pixel circuits are spaced from the plurality of second display elements in a plan view.

20 Claims, 12 Drawing Sheets

(56) References Cited

FOREIGN PATENT DOCUMENTS

| | | | |
|---|---|---|---|
| CN | 111063719 | A | 4/2020 |
| KR | 10-1958287 | B1 | 3/2019 |
| KR | 10-2020-0037029 | A | 4/2020 |

* cited by examiner

DISPLAY APPARATUS AND ELECTRONIC DEVICE INCLUDING THE SAME

CROSS-REFERENCE TO RELATED APPLICATIONS

This application is a continuation of U.S. patent application Ser. No. 17/450,257, filed Oct. 7, 2021, which claims priority to and the benefit of Korean Patent Application No. 10-2020-0144587, filed Nov. 2, 2020, the entire content of both of which is incorporated herein by reference.

BACKGROUND

1. Field

Aspects of one or more embodiments of the present disclosure relate to a display apparatus, and an electronic device including the display apparatus. More particularly, aspects of one or more embodiments of the present disclosure relate to a display apparatus in which a display area is extended to display an image even in an area where an electronic component is located, and an electronic device including the display apparatus.

2. Description of Related Art

Recently, display apparatuses have been used for various purposes. Also, as thicknesses and weights of the display apparatuses have decreased, a range of applications of the display apparatuses has increased.

As an area occupied by a display area in the display apparatuses has increased, various suitable functions linked to or associated with the display apparatuses have increased. In order to increase a size and add various suitable functions, research on a display apparatus having an area inside (e.g., within) a display area for adding various suitable functions, other than displaying an image, is ongoing.

The above information disclosed in this Background section is for enhancement of understanding of the background of the present disclosure, and therefore, it may contain information that does not constitute prior art.

SUMMARY

In order to add various suitable functions to a display apparatus, an electronic component, for example, such as a camera or a sensor, may be located in (e.g., within) a display area of the display apparatus.

One or more embodiments of the present disclosure are directed to a display panel in which a display area is extended to display an image even at (e.g., in or on) an area where an electronic component is located, and an electronic device including the display panel.

However, the present disclosure is not limited to the above aspects and features, and additional aspects and features will be set forth, in part, in the description that follows, and in part, will be apparent from the description, or may be learned by practicing one or more of the presented embodiments of the present disclosure.

According to one or more embodiments of the present disclosure, a display apparatus includes: a first display area, a second display area, and a non-display area surrounding the first display area and the second display area; a plurality of first display elements at the first display area; a plurality of first pixel circuits at the first display area, and electrically connected to the plurality of first display elements, respectively; a plurality of second display elements at the second display area; a plurality of second pixel circuits located along a first direction at the non-display area, and electrically connected to the plurality of second display elements, respectively; and a data line electrically connected to at least one first pixel circuit from among the plurality of first pixel circuits that is located along a second direction crossing the first direction at the first display area, and to at least one second pixel circuit from among the plurality of second pixel circuits. The plurality of second pixel circuits are spaced from the plurality of second display elements in a plan view.

In an embodiment, the plurality of second pixel circuits may be located along the first direction at the non-display area in rows.

In an embodiment, the plurality of second pixel circuits may be located at a portion of the non-display area that is adjacent to the plurality of first pixel circuits.

In an embodiment, at least one of the plurality of first pixel circuits and at least one of the plurality of first display elements may overlap with each other.

In an embodiment, the display apparatus may further include: a plurality of first scan lines extending in the first direction at the first display area, and electrically connected to a plurality of rows of the plurality of first pixel circuits, respectively; and a second scan line extending in the first direction at the non-display area, and electrically connected to the plurality of second pixel circuits.

In an embodiment, an extension length of the second scan line in the first direction may be less than an extension length of the plurality of first scan lines in the first direction.

In an embodiment, the second scan line may be spaced from each of the plurality of first scan lines in the second direction.

In an embodiment, the display apparatus may further include a plurality of connection lines configured to electrically connect the plurality of second display elements to the plurality of second pixel circuits, respectively.

In an embodiment, at least one of the plurality of connection lines may include a first portion at the non-display area, and a second portion at the second display area, and the second portion may include a material different from a material of the first portion.

In an embodiment, the first portion and the second portion may be at different layers from each other, and may contact each other through a contact hole in an insulating layer between the first portion and the second portion.

In an embodiment, the second portion may include a transparent conductive oxide.

In an embodiment, two second pixel circuits that are adjacent to each other in the first direction from among the plurality of second pixel circuits may be electrically connected to two second display elements that are adjacent to each other in the first direction at the second display area from among the plurality of second display elements, respectively.

In an embodiment, two second pixel circuits that are adjacent to each other in the first direction from among the plurality of second pixel circuits may be electrically connected to two second display elements that are adjacent to each other in the second direction at the second display area from among the plurality of second display elements, respectively.

In an embodiment, the display apparatus may further include a scan driving circuit at the non-display area, the scan driving circuit including a plurality of first stages that may be electrically connected to the plurality of first scan lines, respectively, and a second stage that may be electrically connected to the second scan line.

In an embodiment, the display apparatus may further include a start signal line and a clock signal line at the non-display area, the start signal line and the clock signal line being configured to apply a start signal and a clock signal, respectively, to the second stage of the scan driving circuit.

According to one or more embodiments of the present disclosure, a display apparatus includes: a first display area, a second display area, and a non-display area surrounding the first display area and the second display area; a plurality of first display elements at the first display area; a plurality of first pixel circuits at the first display area, and electrically connected to the plurality of first display elements, respectively; a plurality of second display elements at the second display area; a plurality of second pixel circuits located along a first direction at the non-display area, the plurality of second pixel circuits being electrically connected to the plurality of second display elements, respectively, and spaced apart from the plurality of second display elements in a plan view; a plurality of first scan lines extending in the first direction at the first display area, and electrically connected to the plurality of first pixel circuits, respectively; a second scan line extending in the first direction at the non-display area, and electrically connected to the plurality of second pixel circuits; a first scan driving circuit at the non-display area, and configured to apply a first scan signal to the plurality of first pixel circuits through the plurality of first scan lines; a second scan driving circuit at the non-display area, and configured to apply a second scan signal to the plurality of second pixel circuits through the second scan line; a first start signal line electrically connected to the first scan driving circuit, and configured to transmit a first start signal from a display driver; and a second start signal line electrically connected to the second scan driving circuit, and configured to transmit a second start signal from the display driver.

In an embodiment, the display apparatus may further include: a first clock signal line electrically connected to the first scan driving circuit, and configured to transmit a first clock signal from the display driver; and a second clock signal line electrically connected to the second scan driving circuit, and configured to transmit a second clock signal from the display driver.

In an embodiment, the display apparatus may further include a data line electrically connected to one of the plurality of second pixel circuits, and to one of the plurality of first pixel circuits that may be adjacent to the one of the plurality of second pixel circuits in a second direction crossing the first direction.

According to one or more embodiments of the present disclosure, an electronic device includes: a display apparatus including: a first display area; a second display area including a transmissive area; and a non-display area; and an electronic component corresponding to the second display area. The display apparatus further includes: a plurality of first display elements at the first display area; a plurality of first pixel circuits at the first display area, and corresponding to the plurality of first display elements, respectively; a plurality of second display elements located at the second display area, and spaced from each other with the transmissive area therebetween; a plurality of second pixel circuits located along a first direction at the non-display area, and adjacent to the plurality of first pixel circuits to be spaced apart from the plurality of second display elements in a plan view; and a data line electrically connected to one of the plurality of second pixel circuits, and to one of the plurality of first pixel circuits that is adjacent to the one of the plurality of second pixel circuits in a second direction crossing the first direction from among the plurality of first pixel circuits.

In an embodiment, the plurality of second pixel circuits may be located in one row along the first direction.

In an embodiment, the electronic device may further include: a plurality of first scan lines extending in the first direction at the first display area, and electrically connected to a plurality of rows of the plurality of first pixel circuits, respectively; and a second scan line extending in the first direction at the non-display area, and electrically connected to the plurality of second pixel circuits.

In an embodiment, the electronic device may further include a plurality of connection lines configured to electrically connect the plurality of second display elements to the plurality of second pixel circuits, respectively.

In an embodiment, at least one of the plurality of connection lines may include a first portion at the non-display area, and a second portion at the second display area, the second portion including a material different from a material of the first portion.

In an embodiment, the first portion and the second portion may be at different layers from each other, and may contact each other through a contact hole in an insulating layer between the first portion and the second portion.

In an embodiment, the electronic device may further include: a scan driving circuit at the non-display area, and including a plurality of first stages electrically connected to the plurality of first scan lines, respectively, and a second stage electrically connected to the second scan line; and a start signal line and a clock signal line located at the non-display area, and configured to apply a start signal and a clock signal, respectively, to the second stage of the scan driving circuit.

Other aspects and features of the present disclosure will become more apparent from the drawings, the detailed description, and the claims and their equivalents.

The above and other embodiments described herein may be implemented by using a system, a method, a computer program, or a combination thereof.

BRIEF DESCRIPTION OF THE DRAWINGS

The above and other aspects and features of the present disclosure will become more apparent to those skilled in the art from the following detailed description of the embodiments with reference to the accompanying drawings, in which.

DETAILED DESCRIPTION

Figure 1:
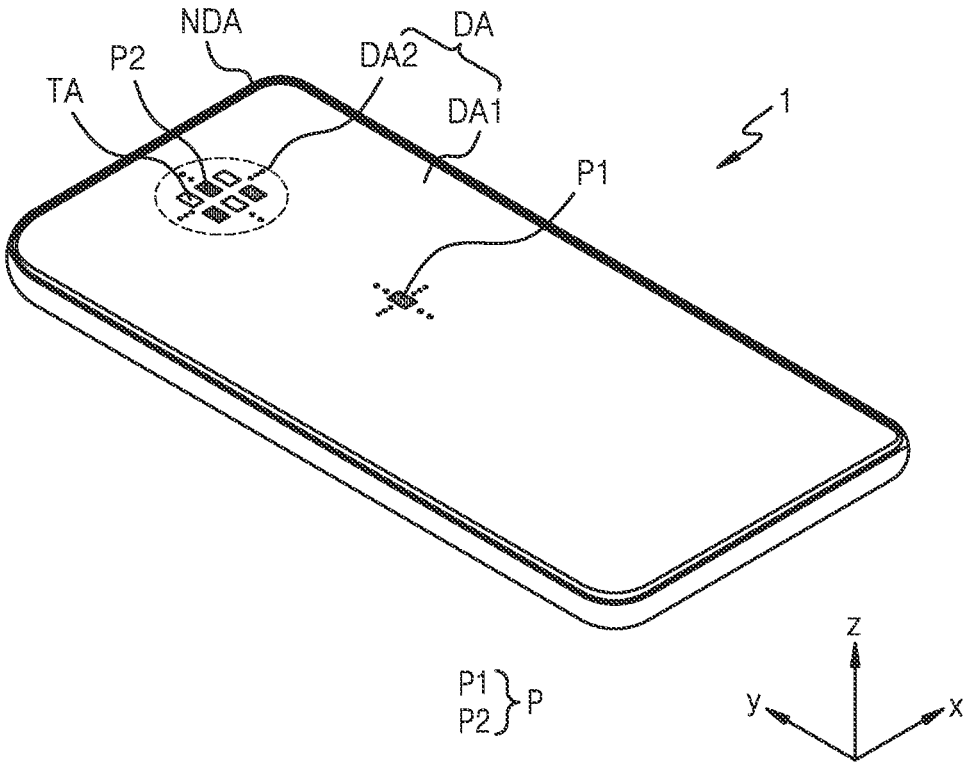
FIG. 1 is a perspective view of an electronic device according to an embodiment.

Hereinafter, embodiments will be described in more detail with reference to the accompanying drawings, in which like reference numbers refer to like elements throughout. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art. Accordingly, processes, elements, and techniques that are not necessary to those having ordinary skill in the art for a complete understanding of the aspects and features of the present disclosure may not be described. Unless otherwise noted, like reference numerals denote like elements throughout the attached drawings and the written description, and thus, descriptions thereof may not be repeated.

When a certain embodiment may be implemented differently, a specific process order may be different from the described order. For example, two consecutively described processes may be performed at the same or substantially at the same time, or may be performed in an order opposite to the described order.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

In the figures, the x-axis, the y-axis, and the z-axis are not limited to three axes of the rectangular coordinate system, and may be interpreted in a broader sense. For example, the x-axis, the y-axis, and the z-axis may be perpendicular to or substantially perpendicular to one another, or may represent different directions from each other that are not perpendicular to one another.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "on," "connected to," or "coupled to" another element or layer, it can be directly on, connected to, or coupled to the other element or layer, or one or more intervening elements or layers may be present. Similarly, when a layer, an area, or an element is referred to as being "electrically connected" to another layer, area, or element, it may be directly electrically connected to the other layer, area, or element, and/or may be indirectly electrically connected with one or more intervening layers, areas, or elements therebetween. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present disclosure. As used herein, the singular forms "a" and "an" are intended to include the plural forms as well, unless the context clearly indicates otherwise. It will be further understood that the terms "comprises," "comprising," "includes," "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, the expression "A and/or B" denotes A, B, or A and B. Expressions such as "at least one of," when preceding a list of elements, modify the entire list of elements and do not modify the individual elements of the list. For example, the expression "at least one of a, b, or c" indicates only a, only b, only c, both a and b, both a and c, both b and c, all of a, b, and c, or variations thereof.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present disclosure refers to "one or more embodiments of the present disclosure." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present disclosure described herein (e.g., the electronic device, the display driver, the scan driving circuit, and/or the like) may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a perspective view of an electronic device according to an embodiment.

Referring to FIG. 1, an electronic device 1 may include a display area DA, and a non-display area NDA located outside the display area DA. The display area DA may include a first display area DA1, and a second display area DA2 adjacent to the first display area DA1. The electronic device 1 may provide an image through an array of pixels P that are two-dimensionally arranged at (e.g., in or on) the display area DA. The electronic device 1 may provide a first image by using light emitted from a plurality of first pixels P1 located at (e.g., in or on) the first display area DA1, and may provide a second image by using light emitted from a plurality of second pixels P2 located at (e.g., in or on) the second display area DA2. In some embodiments, the first image and the second image may be portions of one image (e.g., different portions of the same image) provided through the display area DA of the electronic device 1. As another example, in some embodiments, the electronic device 1 may provide the first image and the second image that are independent of each other.

In FIG. 1, for example, one second display area DA2 is shown as being located at (e.g., within) the first display area DA1. In another embodiment, the electronic device 1 may include two or more second display areas DA2, and the shapes and/or the sizes of the plurality of second display areas DA2 may be different from one another. When viewed from a direction that is perpendicular to or substantially perpendicular to a top surface of the electronic device 1 (e.g., in a plan view), the second display area DA2 may have any of various suitable shapes, for example, such as a circular shape, an elliptical shape, a polygonal shape (e.g., such as a quadrangular shape, a star shape, or a diamond shape), or the like.

Although the second display area DA2 is shown in FIG. 1 as being located at a center of an upper portion (e.g., in the +y-direction) of the first display area DA1 having a quadrangular or substantially quadrangular shape when viewed in the direction that is perpendicular to or substantially perpendicular to the top surface of the electronic device 1 (e.g., in the plan view), the present disclosure is not limited thereto, and the second display area DA2 may be located at any suitable position within or adjacent to the first display area DA1. For example, the second display area DA2 may be located at an upper right portion or an upper left portion of the first display area DA1 having the quadrangular shape. As another example, the second display area DA2 may be located inside (e.g., within) the first display area DA1 as shown in FIG. 1, and may be entirely surrounded (e.g., around a periphery thereof) by the first display area DA1. As another example, the second display area DA2 may be located at (e.g., in or on) a side portion of the first display area DA1, and may be partially surrounded (e.g., around a periphery thereof) by the first display area DA1. For example, the second display area DA2 may be located at (e.g., in or on) a corner portion of the first display area DA1, and may be partially surrounded (e.g., around a periphery thereof) by the first display area DA1.

A ratio between the second display area DA2 and the display area (e.g., the entire display area) DA may be less than a ratio between the first display area DA1 and the display area (e.g., the entire display area) DA. The electronic device 1 may include one second display area DA2 as shown in FIG. 1, or may include two or more second display areas DA2.

An electronic component 40 (e.g., see FIG. 2) may be located at (e.g., in or on) the second display area DA2. The electronic component 40 may be located under (e.g., underneath) the display apparatus 10 (e.g., see FIG. 2) to correspond to the second display area DA2.

The electronic component 40 may be an electronic element that uses light or sound. For example, the electronic element may be a sensor that measures a distance such as a proximity sensor, a sensor that recognizes a user's body part (e.g., a fingerprint, an iris, or a face), a small lamp that outputs light, or an image sensor (e.g., a camera) that captures an image. The electronic element that uses light may use light of any of various suitable wavelength bands, for example, such as visible light, infrared light, or ultraviolet light. The electronic element that uses sound may use ultrasound or sound of another suitable frequency band.

In order to reduce or minimize a function of the electronic component 40 from being limited, the second display area DA2 may include a transmissive area TA through which light and/or sound output from the electronic component 40 to the outside or traveling from the outside toward the electronic component 40 may be transmitted. The transmissive area TA may be an area through which light may be transmitted, and where a pixel is not located. In the case of the electronic device 1 according to an embodiment, when light is transmitted through the second display area DA2 including the transmissive area TA, a light transmittance thereof may be equal to or substantially equal to, or greater than, about 10%. For example, in various embodiments, the light transmittance may be equal to or substantially equal to, or greater than, about 25%, about 40%, about 50%, about 85%, or about 90%.

Because the second display area DA2 includes the transmissive area TA, an array of the first pixels P1 located at (e.g., in or on) the first display area DA1 and an array of the second pixels P2 located at (e.g., in or on) the second display area DA2 may be different from each other. For example, the transmissive area TA may be located between adjacent second pixels P2 from among the plurality of second pixels P2. In this case, a second image provided through the second display area DA2 may have a resolution that is lower than that of a first image provided through the first display area DA1. In other words, because the second display area DA2 includes the transmissive area TA, a number of second pixels P2 that may be located per unit area at (e.g., in or on) the second display area DA2 may be less than a number of first pixels P1 that may be located per unit area at (e.g., in or on) the first display area DA1.

The non-display area NDA where an image is not provided may entirely or partially surround (e.g., around a periphery of) the display area DA. A driver or the like for applying an electrical signal or power to the pixels P may be located at (e.g., in or on) the non-display area NDA. A pad to which an electronic element or a printed circuit board may be electrically connected may be located at (e.g., in or on) the non-display area NDA.

Some examples of the electronic device 1 may include a mobile phone, a tablet PC, a laptop, a smart watch, a smart band worn on a wrist, and/or the like.

Figure 2:
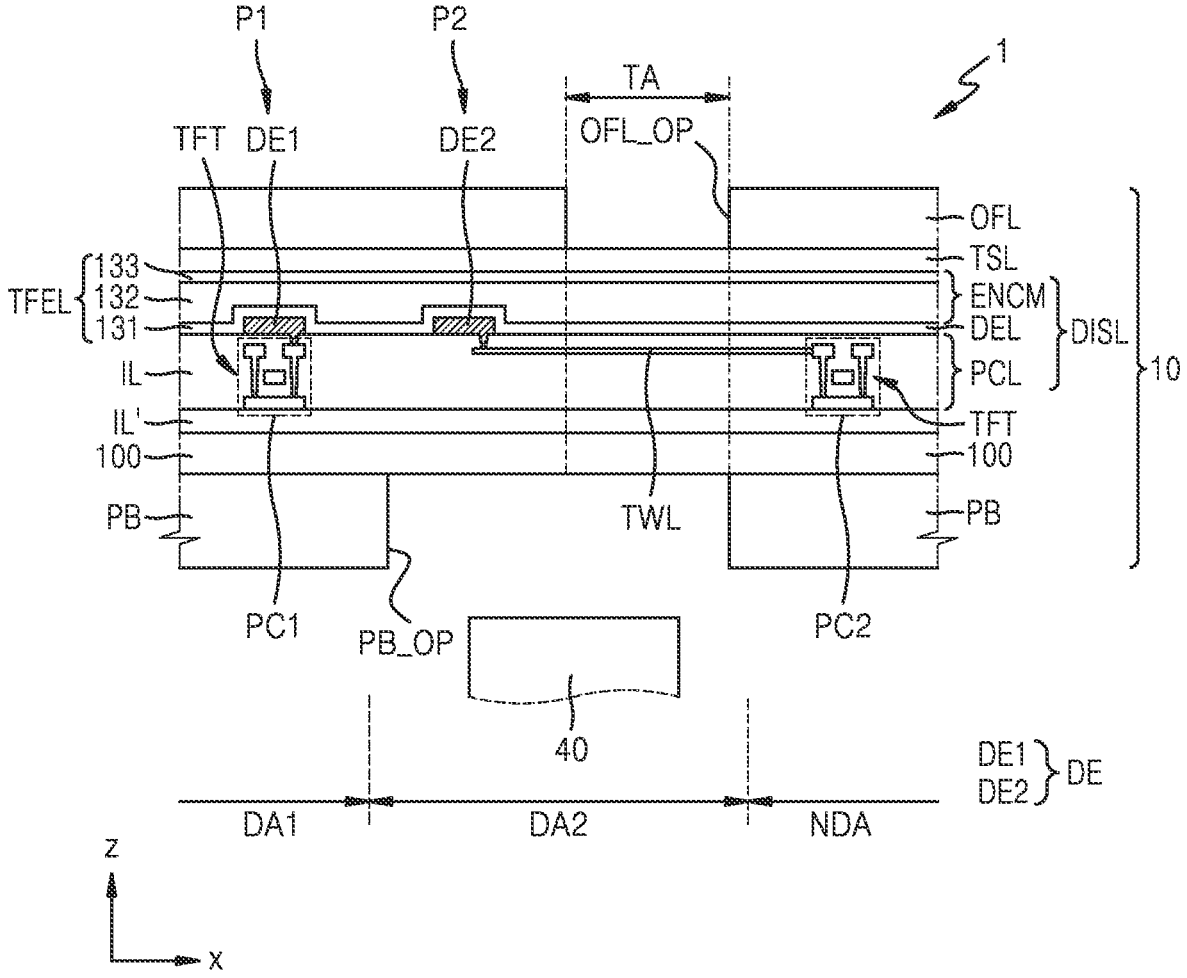
FIG. 2 is a cross-sectional view illustrating a part of an electronic device according to an embodiment.

FIG. 2 is a cross-sectional view illustrating a part of an electronic device according to an embodiment.

Referring to FIG. 2, the electronic device 1 may include a display apparatus 10, and the electronic component 40 overlapping with the display apparatus 10. A cover window for protecting the display apparatus 10 may be further located over the display apparatus 10.

The display apparatus 10 may include the first display area DA1, and the second display area DA2 overlapping with the electronic component 40. The display apparatus 10 may include a substrate 100, and a display layer DISL, a touchscreen layer TSL, and an optical functional layer OFL, which are located over the substrate 100. The display apparatus 10 may further include a panel protection member PB that is located under (e.g., underneath) the substrate 100.

The display layer DISL may include a circuit layer PCL including a thin-film transistor TFT, a display element layer DEL including a display element DE, and a sealing member ENCM, for example, such as a thin-film encapsulation layer TFEL (e.g., as shown in FIG. 2) or a sealing substrate. Insulating layers IL and IL' may be located between the substrate 100 and the display layer DISL, and in the display layer DISL.

The substrate 100 may be formed of an insulating material, for example, such as glass, quartz, or a polymer resin. The substrate 100 may be a rigid substrate, or a flexible substrate that is bendable, foldable, and/or rollable.

A plurality of first pixel circuits PC1, and a plurality of first display elements DE1 electrically connected to the plurality of first pixel circuits PC1, respectively, may be located at (e.g., in or on) the first display area DA1 of the display apparatus 10. The first pixel circuit PC1 may include at least one thin-film transistor TFT, and may control the light emission of the first display element DE1. The first display element DE1 may emit light through an emission area, and the emission area may be defined as the first pixel P1. In other words, the first pixel P1 may be implemented by the light emission of the first display element DE1.

A plurality of second display elements DE2 may be located at (e.g., in or on) the second display area DA2 of the display apparatus 10. According to an embodiment, a second pixel circuit PC2 for controlling the light emission of the second display element DE2 may not be located at (e.g., in or on) the second display area DA2, and may be located at (e.g., in or on) the non-display area NDA. However, the present disclosure is not limited thereto, and various suitable modifications may be made. For example, in another embodiment, the second pixel circuit PC2 may be located at (e.g., in or on) a portion of the first display area DA1, or may be located between the first display area DA1 and the second display area DA2. In other words, the second pixel circuit PC2 may not overlap with the second display element DE2.

The second pixel circuit PC2 may include at least one thin-film transistor TFT, and may be electrically connected to the second display element DE2 via a connection line TWL. For example, the connection line TWL may be formed of a transparent conductive material. The second pixel circuit PC2 may control the light emission of the second display element DE2. The second display element DE2 may emit light through an emission area, and the emission area may be defined as the second pixel P2. In other words, the second pixel PC2 may be implemented by the light emission of the second display element DE2.

A portion of the second display area DA2 where the second display element DE2 is not located may include the transmissive area TA. The transmissive area TA may be an area through which light and/or a signal emitted from the electronic component 40 located to correspond to the second display area DA2, or light and/or a signal incident on the electronic component 40, is transmitted.

The connection line TWL for electrically connecting the second pixel circuit PC2 to the second display element DE2 may be located at (e.g., in or on) the transmissive area TA. Because the connection line TWL may be formed of a transparent conductive material having a high transmittance, even when the connection line TWL is located at (e.g., in or on) the transmissive area TA, a decrease in a transmittance of the transmissive area TA may be prevented or substantially prevented.

In an embodiment, because the second pixel circuit PC2 is not located at (e.g., in or on) the second display area DA2, the area of the transmissive area TA may be sufficiently secured, and a light transmittance thereof may be further increased.

The display element layer DEL may be covered by the thin-film encapsulation layer TFEL (e.g., as shown in FIG. 2), or may be covered by the sealing substrate. In some embodiments, as shown in FIG. 2, the thin-film encapsulation layer TFEL may include at least one inorganic encapsulation layer, and at least one organic encapsulation layer. In an embodiment, the thin-film encapsulation layer TFEL may include a first inorganic encapsulation layer 131, a second inorganic encapsulation layer 133, and an organic encapsulation layer 132 between the first inorganic encapsulation layer 131 and the second inorganic encapsulation layer 133.

Each of the first inorganic encapsulation layer 131 and the second inorganic encapsulation layer 133 may include at least one inorganic insulating material, for example, such as silicon oxide ($SiO_2$), silicon nitride ($SiN_x$), silicon oxynitride ($SiO_xN_y$), aluminum oxide ($Al_2O_3$), titanium oxide ($TiO_2$), tantalum oxide ($Ta_2O_5$), hafnium oxide ($HfO_2$), or zinc oxide ($ZnO_2$), and may be formed by using chemical vapor deposition (CVD) or the like. The organic encapsulation layer 132 may include a polymer-based material. Examples of the polymer-based material may include silicon-based resin, acrylic resin, epoxy resin, polyimide, and/or polyethylene.

The first inorganic encapsulation layer 131, the organic encapsulation layer 132, and the second inorganic encapsulation layer 133 may be integrally formed to cover the first display area DA1 and the second display area DA2.

As another embodiment, when the display element layer DEL is sealed with the sealing substrate, the sealing substrate may face the substrate 100 with the display element layer DEL therebetween. A gap may be between the sealing substrate and the display element layer DEL. The sealing substrate may include glass. A sealant, for example, such as a frit or the like, may be located between the substrate 100 and the sealing substrate, and may be located at (e.g., in or on) the non-display area NDA. The sealant located at (e.g., in or on) the non-display area NDA may surround (e.g., around a periphery of) the display area DA, and may prevent or reduce the penetration of moisture through a side surface of the display apparatus 10.

The touchscreen layer TSL may obtain coordinate information according to an external input, for example, such as a touch event. The touchscreen layer TSL may include a touch electrode, and touch wirings connected to the touch electrode. The touchscreen layer TSL may detect the external input by using a self-capacitive method or a mutual capacitive method.

The touchscreen layer TSL may be formed on the thin-film encapsulation layer TFEL. As another example, the touchscreen layer TSL may be separately formed on a touch substrate, and then may be connected to the thin-film encapsulation layer TFEL through an adhesive layer, for example, such as an optically clear adhesive (OCA). In an embodiment, the touchscreen layer TSL may be formed directly on the thin-film encapsulation layer TFEL, and in this case, the adhesive layer may not be located between the touchscreen layer TSL and the thin-film encapsulation layer TFEL.

The optical functional layer OFL may include an anti-reflection layer. The anti-reflection layer may reduce a reflectance of light (e.g., of external light) that is incident on the electronic device 1.

In some embodiments, the optical functional layer OFL may include (e.g., may be) a polarizing film. The optical functional layer OFL may have an opening OFL_OP corresponding to the transmissive area TA. Accordingly, a light transmittance of the transmissive area TA may be increased (e.g., may be significantly increased). A transparent material, for example, such as an optically clear resin (OCR), may be filled in the opening OFL_OP.

In some embodiments, the optical functional layer OFL may be provided as a filter plate including a black matrix and color filters.

The panel protection member PB may be attached to a bottom (e.g., a rear surface) of the substrate 100, and may support and protect the substrate 100. The panel protection member PB may have an opening PB_OP corresponding to the second display area DA2. Because the panel protection member PB has the opening PB_OP, a light transmittance of the second display area DA2 may be increased. The panel protection member PB may include polyethylene terephthalate (PET) or polyimide (PI).

The second display area DA2 may be larger than an area where the electronic component 40 is located. Accordingly, the area of the opening PB_OP of the panel protection member PB may not be the same as the area of the second display area DA2.

One or more electronic components 40 may be provided at (e.g., in or on) the second display area DA2. When a plurality of electronic components 40 are provided, the plurality of electronic components 40 may have different functions from one another. For example, the plurality of electronic components 40 may include at least two of a camera (e.g., an image pickup device), a solar cell, a flash, a proximity sensor, an illuminance sensor, and/or an iris sensor.

Although not shown in FIG. 2, in some embodiments, the electronic device 1 may include a bottom metal layer. The bottom metal layer may be located under (e.g., underneath) the second display element DE2 of the second display area DA2. The bottom metal layer may be located between the substrate 100 and the second display element DE2, to overlap with the second display element DE2. The bottom metal layer may prevent or substantially prevent external light from reaching the second display element DE2.

Figure 3:
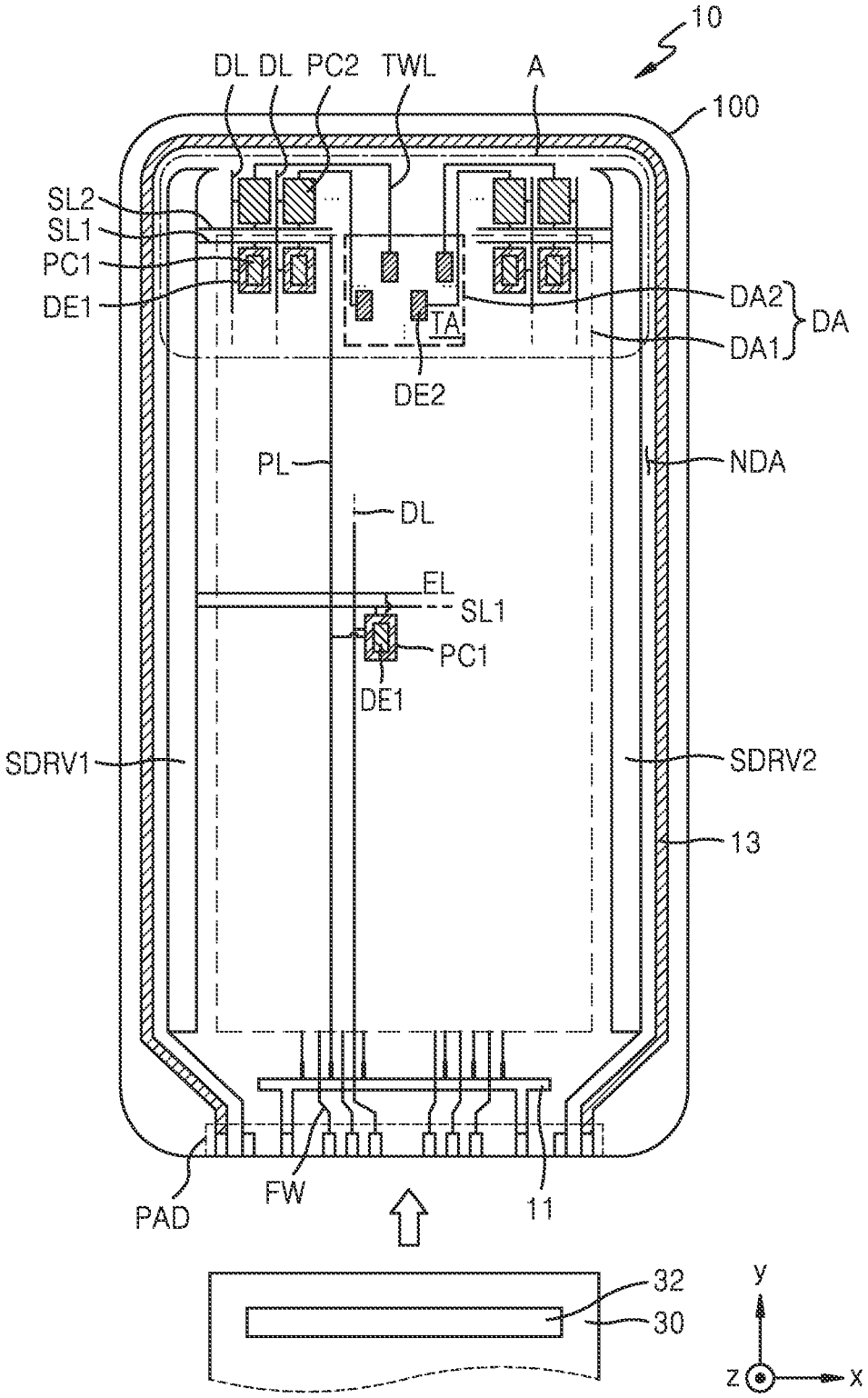
FIG. 3 is a plan view of a display apparatus that may be included in the electronic device of FIG. 1.

FIG. 3 is a plan view of a display apparatus that may be included in the electronic device of FIG. 1.

Referring to FIG. 3, the elements of the display apparatus 10 may be located on the substrate 100. A plurality of first display elements DE1 may be located on the substrate 100 at (e.g., in or on) the first display area DA1. At least one first pixel circuit PC1 from among a plurality of first pixel circuits PC1 for driving the plurality of first display elements DE1 may overlap with at least one first display element DE1 from among the plurality of first display elements DE1.

A plurality of second display elements DE2 may be located on the substrate 100 at (e.g., in or on) the second display area DA2. The plurality of second display elements DE2 may be spaced apart from each other with the transmissive area TA therebetween. A plurality of second pixel circuits PC2 for driving the plurality of second display elements DE2 may be located at (e.g., in or on) the non-display area NDA. According to an embodiment, the plurality of second pixel circuits PC2 may be spaced apart from the plurality of second display elements DE2 in a plan view, and may be located at (e.g., in or on) a portion of the non-display area that is adjacent to the plurality of first pixel circuits PC1. In other words, the second pixel circuits PC2 may be located at (e.g., in or on) a portion of the non-display area NDA that is adjacent to the first display area DA1, and not at (e.g., in or on) the second display area DA2. The second display elements DE2 and the second pixel circuits PC2 may not overlap with each other.

The display apparatus 10 may include a plurality of connection lines TWL for electrically connecting the plurality of second display elements DE2 to the plurality of second pixel circuits PC2, respectively. The second pixel circuits PC2 may drive the second display elements DE2 through the connection lines TWL, respectively.

The plurality of first pixel circuits PC1 and the plurality of second pixel circuits PC2 may be respectively electrically connected to outer circuits located at (e.g., in or on) the non-display area NDA. A first scan driving circuit SDRV1, a second scan driving circuit SDRV2, a terminal unit (e.g., a pad area or a pad terminal area) PAD, a driving voltage supply line 11, and a common voltage supply line 13 may be located at (e.g., in or on) the non-display area NDA.

The first scan driving circuit SDRV1 may apply a scan signal to the plurality of first pixel circuits PC1 through a plurality of first scan lines SL1. Also, according to an embodiment, the first scan driving circuit SDRV1 may apply a scan signal to the plurality of second pixel circuits PC2 through one second scan line SL2.

The second scan driving circuit SDRV2 may be located opposite to the first scan driving circuit SDRV1 with the first display area DA1 therebetween, and may be parallel to or substantially parallel to the first scan driving circuit SDRV1. Some of the plurality of first pixel circuits PC1 may be electrically connected to the first scan driving circuit SDRV1, and the others of the plurality of first pixel circuits PC1 may be electrically connected to the second scan driving circuit SDRV2. The second scan driving circuit SDRV2 may also apply a scan signal to the plurality of first pixel circuits PC1 through the plurality of first scan lines SL1, and may apply a scan signal to the plurality of second pixel circuits PC2 through one second scan line SL2.

In another embodiment, the display apparatus 10 may include the first scan driving circuit SDRV1 without the second scan driving circuit SDRV2, and in this case, both the plurality of first pixel circuits PC1 and the plurality of second pixel circuits PC2 may be electrically connected to the first scan driving circuit SDRV1.

The first scan driving circuit SDRV1 and/or the second scan driving circuit SDRV2 may apply an emission control signal to the plurality of first pixel circuits PC1 and the plurality of second pixel circuits PC2 through an emission control line EL.

The terminal unit PAD may be located on a side portion (e.g., an end portion) of the substrate 100. The terminal unit PAD may be exposed without being covered by an insulating layer, and may be connected to a display circuit board 30. A display driver 32 may be located on the display circuit board 30

The display driver 32 may generate a control signal transmitted to the first scan driving circuit SDRV1 and the second scan driving circuit SDRV2. The display driver 32 may generate a data signal, and the generated data signal may be transmitted to the first pixel circuits PC1 and the second pixel circuits PC2 through a fan-out wiring FW and a data line DL connected to the fan-out wiring FW.

The display driver 32 may supply a driving voltage ELVDD to the driving voltage supply line 11, and may supply a common voltage ELVSS to the common voltage supply line 13. The driving voltage ELVDD may be applied to the first pixel circuits PC1 through a driving voltage line PL connected to the driving voltage supply line 11, and the common voltage ELVSS may be applied to a counter electrode of a display element connected to the common voltage supply line 13.

The driving voltage supply line 11 may be located below the first display area DA1, and may extend in the x-direction. The common voltage supply line 13 may have a loop shape with an open side, and may partially surround (e.g., around a periphery of) the first display area DA1.

Although one second display area DA2 is illustrated in FIG. 3, a plurality of second display areas DA2 may be provided as described above. In this case, the plurality of second display areas DA2 may be spaced apart from one another. For example, a first camera may be located to correspond to one second display area DA2 from among the plurality of second display areas DA2, and a second camera may be located to correspond to another second display area DA2 from among the plurality of second display areas DA2. As another example, a camera may be located to correspond to one second display area DA2 from among the plurality of second display areas DA2, and an infrared sensor may be located to correspond to another second display area DA2 from among the plurality of second display areas DA2.

Figure 4:
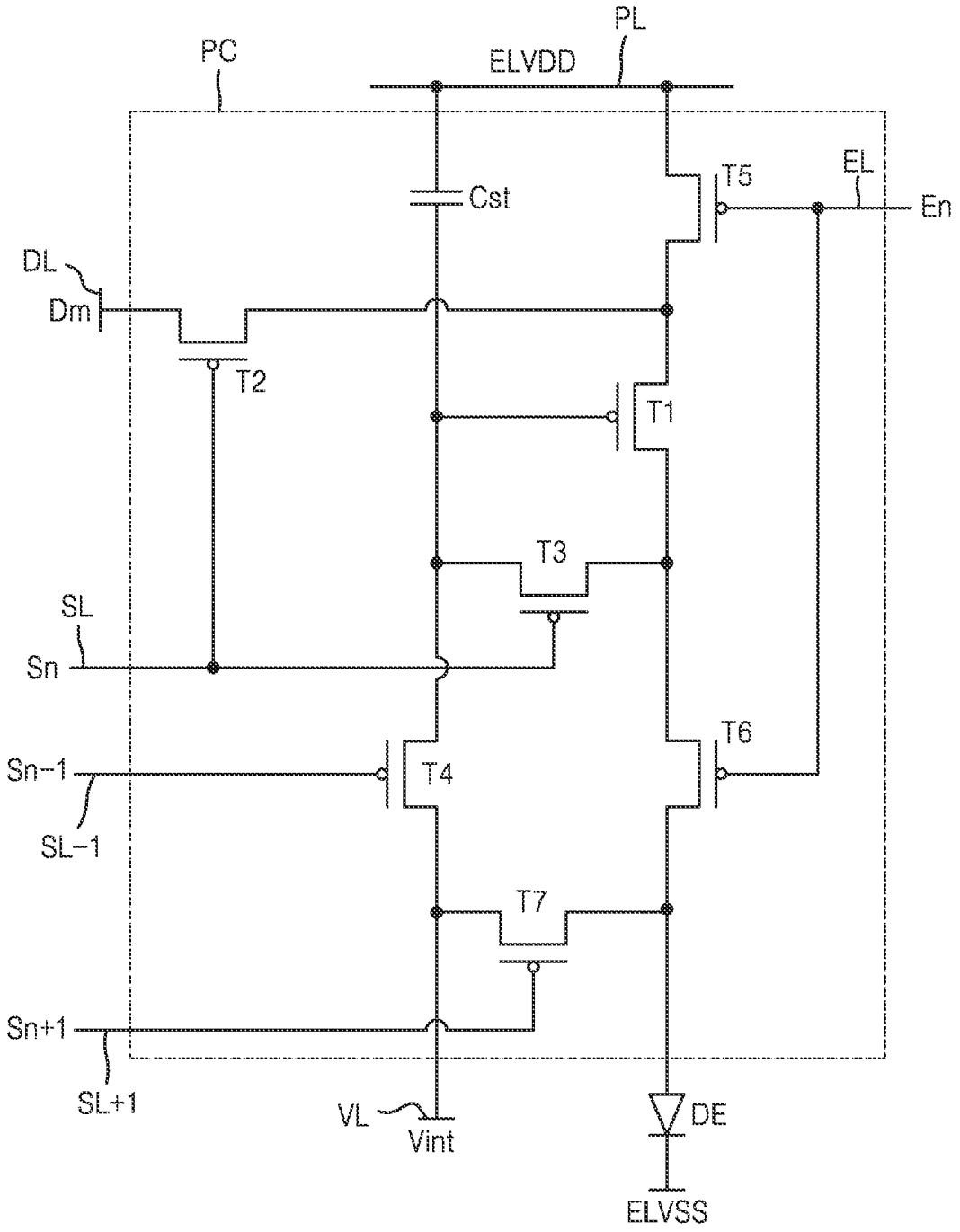
FIG. 4 is an equivalent circuit diagram of a pixel circuit that may be included in an electronic device according to an embodiment.

FIG. 4 is an equivalent circuit diagram of a pixel circuit that may be included in an electronic device according to an embodiment.

Referring to FIG. 4, a pixel circuit PC may include a driving thin-film transistor T1, a switching thin-film transistor T2, a compensation thin-film transistor T3, a first initialization thin-film transistor T4, an operation control thin-film transistor T5, an emission control thin-film transistor T6, a second initialization thin-film transistor T7, and a storage capacitor Cst.

Although each pixel circuit PC is shown in FIG. 4 as including a plurality of signals lines (e.g., a scan line SL, a previous scan line SL−1, a next scan line SL+1, the emission control line EL, and the data line DL), an initialization voltage line VL, and the driving voltage line PL, the present disclosure is not limited thereto. As another example, at least one of the signal lines (e.g., the scan line SL, the previous scan line SL−1, the next scan line SL+1, the emission control line EL, and/or the data line DL), and/or the initialization voltage line VL may be shared by neighboring pixel circuits (e.g., by adjacent pixel circuits).

A drain electrode of the driving thin-film transistor T1 may be electrically connected to the display element DE via the emission control thin-film transistor T6. The driving thin-film transistor T1 may receive a data signal Dm according to a switching operation of the switching thin-film transistor T2, and may supply a driving current to the display element DE.

A gate electrode of the switching thin-film transistor T2 is connected to the scan line SL, and a source electrode of the switching thin-film transistor T2 is connected to the data line DL. A drain electrode of the switching thin-film transistor T2 may be connected to a source electrode of the driving thin-film transistor T1, and to the driving voltage line PL via the operation control thin-film transistor T5.

The switching thin-film transistor T2 may be turned on according to a scan signal Sn received through the scan line SL, and may perform a switching operation to transmit the data signal Dm through the data line DL to the source electrode of the driving thin-film transistor T1.

A gate electrode of the compensation thin-film transistor T3 may be connected to the scan line SL. A source electrode of the compensation thin-film transistor T3 may be connected to the drain electrode of the driving thin-film transistor T1, and to a pixel electrode of the display element DE via the emission control thin-film transistor T6. A drain electrode of the compensation thin-film transistor T3 may be connected to one electrode of the storage capacitor Cst, a source electrode of the first initialization thin-film transistor T4, and a gate electrode of the driving thin-film transistor T1. The compensation thin-film transistor T3 may be turned on according to the scan signal Sn received through the scan line SL, and may diode-connect the driving thin-film transistor T1 by connecting the gate electrode of the driving thin-film transistor T1 and the drain electrode of the driving thin-film transistor T1 to each other.

A gate electrode of the first initialization thin-film transistor T4 may be connected to the previous scan line SL−1. A drain electrode of the first initialization thin-film transistor T4 may be connected to the initialization voltage line VL. The source electrode of the first initialization thin-film transistor T4 may be connected to the one electrode of the storage capacitor Cst, the drain electrode of the compensation thin-film transistor T3, and the gate electrode of the driving thin-film transistor T1. The first initialization thin-film transistor T4 may be turned on according to a previous scan signal Sn−1 received through the previous scan line SL−1, and may perform an initialization operation of initializing a voltage of the gate electrode of the driving thin-film transistor T1 by supplying an initialization voltage Vint to the gate electrode of the driving thin-film transistor T1.

A gate electrode of the operation control thin-film transistor T5 may be connected to the emission control line EL. A source electrode of the operation control thin-film transistor T5 may be connected to the driving voltage line PL. A drain electrode of the operation control thin-film transistor T5 may be connected to the source electrode of the driving thin-film transistor T1 and the drain electrode of the switching thin-film transistor T2.

A gate electrode of the emission control thin-film transistor T6 may be connected to the emission control line EL. A source electrode of the emission control thin-film transistor T6 may be connected to the drain electrode of the driving thin-film transistor T1 and the source electrode of the compensation thin-film transistor T3. A drain electrode of the emission control thin-film transistor T6 may be electrically connected to the pixel electrode of the display element DE. The operation control thin-film transistor T5 and the emission control thin-film transistor T6 may be concurrently (e.g., simultaneously) turned on according to an emission control signal En received through the emission control line EL, and thus, the driving voltage ELVDD may be supplied to the display element DE, and the driving current may flow through the display element DE.

A gate electrode of the second initialization thin-film transistor T7 may be connected to the next scan line SL+1. A source electrode of the second initialization thin-film transistor T7 may be connected to the pixel electrode of the display element DE. A drain electrode of the second initialization thin-film transistor T7 may be connected to the initialization voltage line VL. The second initialization thin-film transistor T7 may be turned on according to a next scan signal Sn+1 received through the next scan line SL+1, and may initialize the pixel electrode of the display element DE.

Although FIG. 4 shows that the first initialization thin-film transistor T4 and the second initialization thin-film transistor T7 are connected to the previous scan line SL−1 and the next scan line SL+1, respectively, the present disclosure is not limited thereto. In another embodiment, both the first initialization thin-film transistor T4 and the second initialization thin-film transistor T7 may be connected to a first scan line SLn−1, and may be driven according to the previous scan signal Sn−1.

Any suitable one electrode of the storage capacitor Cst may be connected to the gate electrode of the driving thin-film transistor T1, the drain electrode of the compensation thin-film transistor T3, and the source electrode of the first initialization thin-film transistor T4, as discussed above. Another electrode of the storage capacitor Cst may be connected to the driving voltage line PL.

A counter electrode (e.g., a cathode) of the display element DE may receive the common voltage ELVSS. The display element DE may receive the driving current from the driving thin-film transistor T1, and may emit light according to the driving current.

The number of thin-film transistors and/or the number of storage capacitors, and a circuit design of the pixel circuit PC are not limited to those shown in FIG. 4, and may be variously modified as needed or desired as would be understood by those having ordinary skill in the art.

The pixel circuit PC of FIG. 4 may be applied to the first pixel circuit PC1 and/or the second pixel circuit PC2 (e.g., see FIG. 3). In some embodiments, the configurations and/or the circuit designs of the first pixel circuit PC1 and the second pixel circuit PC2 may be different from each other. For example, the pixel circuit PC of FIG. 4 may be applied to the first pixel circuit PC1, and the second pixel circuit PC2 may include a different number of thin-film transistors and/or storage capacitors from those of the first pixel circuit PC1, for example, such as three thin-film transistors and two storage capacitors.

Figure 5:
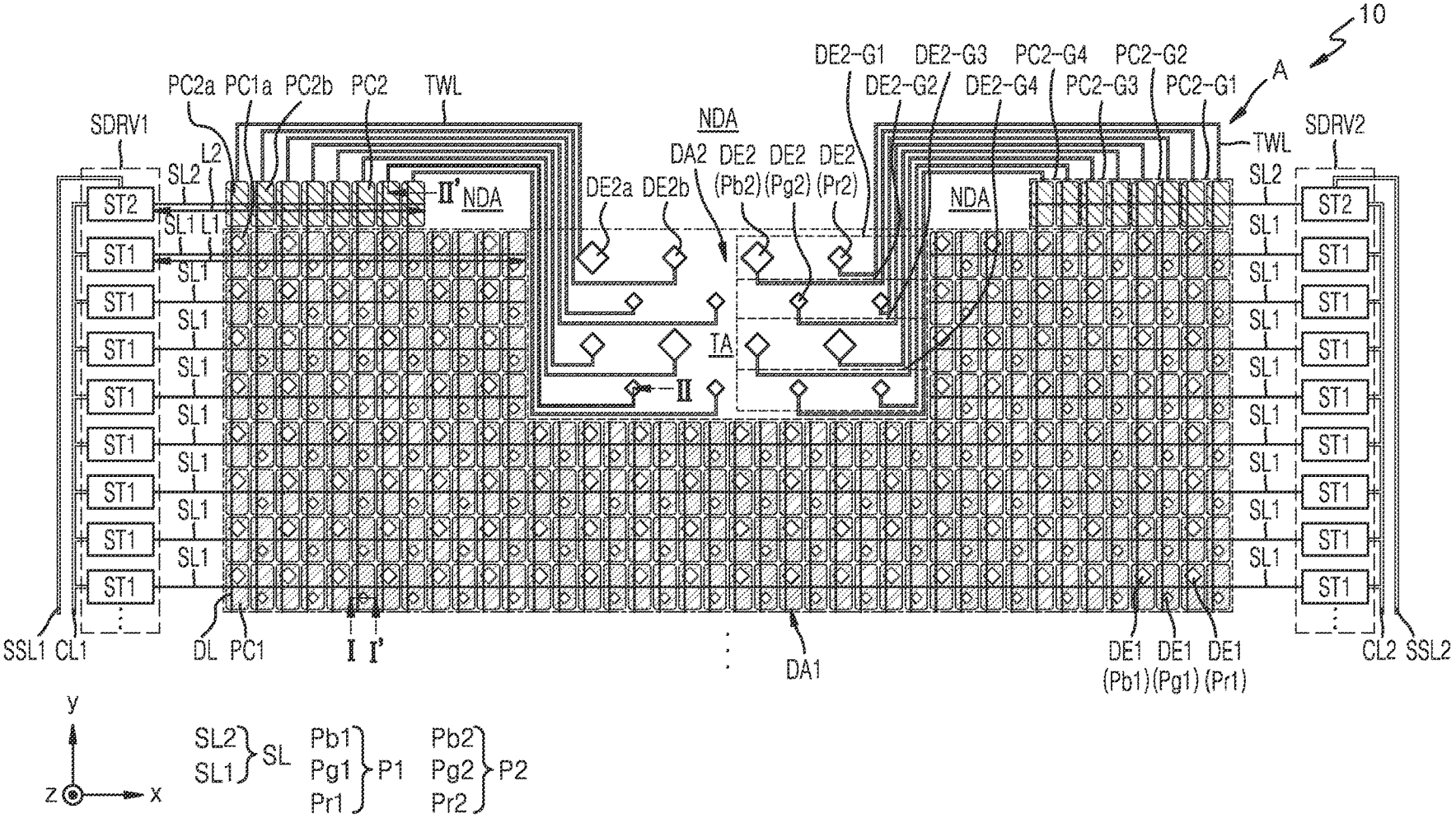
FIG. 5 is a plan view illustrating a portion of a display apparatus according to an embodiment.

FIG. 5 is a plan view illustrating a portion of a display apparatus according to an embodiment. FIG. 5 may correspond to an enlarged view of the portion A of FIG. 3.

Referring to FIG. 5, a plurality of first pixel circuits PC1 may be two-dimensionally arranged in rows and columns along the x-direction (e.g., a row direction) and the y-direction (e.g., a column direction) at (e.g., in or on) the first display area DA1. At least one first display element DE1 from among a plurality of first display elements DE1 may correspondingly overlap with at least one first pixel circuit PC1 from among the plurality of first pixel circuits PC1.

A first pixel P1 may be defined as an emission area of the first display element DE1. The plurality of first display elements DE1 may emit red light, green light, and blue light, respectively. An emission area of the first display element DE1 that emits red light may define a red first pixel Pr1. An emission area of the first display element DE1 that emits green light may define a green first pixel Pg1. An emission area of the first display element DE1 that emits blue light may define a blue first pixel Pb1.

In an embodiment, as shown in FIG. 5, the red first pixel Pr1, the green first pixel Pg1, and the blue first pixel Pb1 may be arranged in an RGBG type arrangement (e.g., in a PENTILE® arrangement, PENTILE® being a duly registered trademark of Samsung Display Co., Ltd.). In another embodiment, the red first pixel Pr1, the green first pixel Pg1, and the blue first pixel Pb1 may be arranged in a stripe type arrangement.

The red first pixel Pr1, the green first pixel Pg1, and the blue first pixel Pb1 may have different sizes (or different widths) from each other. For example, the blue first pixel Pb1 may be larger than the red first pixel Pr1 and the green first pixel Pg1, and the red first pixel Pr1 may be larger than the green first pixel Pg1. In some embodiments, the green first pixel Pg1 may have a rectangular shape, and adjacent green first pixels Pg1 may extend in different directions from each other.

A plurality of second pixel circuits PC2 may be arranged along the x-direction (e.g., the row direction) at (e.g., in or on) the non-display area NDA, and may be arranged in one or more rows. For example, the plurality of second pixel circuits PC2 may be arranged in one row. However, the present disclosure is not limited thereto, and the plurality of second pixel circuits PC2 may be arranged in two or more rows, but it may be desirable for the plurality of second pixel circuits PC2 to be arranged in one row, for example, as shown in FIG. 5. For convenience of explanation, the description hereinafter assumes that the plurality of second pixel circuits PC2 form one row.

In an embodiment, the plurality of second pixel circuits PC2 may be located at (e.g., in or on) a portion of the non-display area NDA that is adjacent to the first display area DA1. Accordingly, the plurality of second pixel circuits PC2 located at (e.g., in or on) the non-display area NDA may form (e.g., may be a part of or may be located in) the same columns with some of the plurality of first pixel circuits PC1 located at (e.g., in or on) the first display area DA1.

A plurality of second display elements DE2 may be two-dimensionally arranged in rows and columns along the x-direction (e.g., the row direction) and the y-direction (e.g., the column direction) at (e.g., in or on) the second display area DA2. Adjacent ones of the second display elements DE2 may be spaced apart from each other with the transmissive area TA therebetween. For example, the transmissive area TA may surround (e.g., around a periphery of) the second display element DE2. As another example, a plurality of the transmissive areas TA and the plurality of second pixels P2 may be arranged in a lattice shape, so that the plurality of second display elements DE2 and the plurality of transmissive areas TA are alternately arranged in a lattice shape.

As described above, because the plurality of second pixel circuits PC2 are located at (e.g., in or on) the non-display area NDA, and the plurality of second display elements DE2 are located at (e.g., in or on) the second display area DA2, the second pixel circuit PC2 and the second display element DE2 may be spaced apart from each other and may not overlap with each other. Accordingly, because the plurality of second pixel circuits PC2 are not located at (e.g., in or on) the second display area DA2, the area of the transmissive area TA at (e.g., in or on) the second display area DA2 may be sufficiently secured, and thus, a light transmittance of the second display area DA2 may be further increased.

The second pixel P2 may be defined as an emission area of the second display element DE2. The plurality of second display elements DE2 may emit red light, green light, and blue light, respectively. An emission area of the second display element DE2 that emits red light may define a red second pixel Pr2. An emission area of the second display element DE2 that emits green light may define a green second pixel Pg2. An emission area of the second display element DE2 that emits blue light may define a blue second pixel Pb2. Arrangement types and/or sizes of the red second pixel Pr2, the green second pixel Pg2, and the blue second pixel Pb2 may be the same or substantially the same as those of the first pixel P1 (e.g., the red first pixel Pr1, the green first pixel Pg1, and the blue first pixel Pb1) described above, and thus, redundant description thereof may not be repeated.

Because the second display area DA2 includes the transmissive area TA, a resolution of the second display area DA2 may be lower than a resolution of the first display area DA1. For example, the resolution of the second display area DA2 may be about ½, ⅜, ⅓, ¼, ⅔, ⅛, ⅙, or 1/16 of the resolution of the first display area DA1. For example, the resolution of the first display area DA1 may be about 400 ppi or more, and the resolution of the second display area DA2 may be about 200 ppi or about 100 ppi.

Although the plurality of second pixel circuits PC2 are spaced apart from the plurality of second display elements DE2, the plurality of second pixel circuits PC2 may be electrically connected to the plurality of second display elements DE2 to drive the plurality of second display elements DE2. Thus, the plurality of connection lines TWL for electrically connecting the plurality of second display elements DE2 to the plurality of second pixel circuits PC2, respectively, may be provided.

The plurality of connection lines TWL may extend from the second pixel circuits PC2 to the second display elements DE2, respectively, in the x-direction and/or the y-direction. Although FIG. 5 shows that the connection lines TWL are located at (e.g., in or on) the non-display area NDA and the second display area DA2, the present disclosure is not limited thereto, and in some embodiments, the plurality of connection lines TWL may extend even at (e.g., in or on) the first display area DA1. In an embodiment, two second pixel circuits PC2*a* and PC2*b* that are adjacent to each other in the x-direction (e.g., the row direction) from among the plurality of second pixel circuits PC2 located at (e.g., in or on) the non-display area NDA may be electrically connected through the connection lines TWL to two second display elements DE2*a* and DE2*b* that are adjacent to each other in the x-direction (e.g., the row direction) at (e.g., in or on) the second display area DA2, respectively.

A first group of second pixel circuits PC2-G1 including second pixel circuits PC2 that are sequentially arranged along the x-direction (e.g., the row direction) from among the plurality of second pixel circuits PC2 located at (e.g., in or on) the non-display area NDA may be respectively electrically connected through the connection lines TWL to a first group of second display elements DE2-G1 including second display elements DE2 that are sequentially arranged along the x-direction (e.g., the row direction) from among the second display elements DE2 located at (e.g., in or on) the second display area DA2.

Similarly, a second group of pixel circuits PC2-G2 may be respectively electrically connected to a second group of second display elements DE2-G2, a third group of pixel circuits PC2-G3 may be respectively electrically connected to a third group of second display elements DE2-G3, and fourth group of pixel circuits PC2-G4 may be respectively electrically connected to a fourth group of second pixel elements DE2-G4.

In an embodiment, the first group of the pixel circuits PC2-G1 and the second group of the pixel circuits PC2-G2 may be arranged to be adjacent to each other in the x-direction (e.g., the row direction). On the other hand, the first group of the second display elements DE2-G1 and the second group of the second display elements DE2-G2 may be arranged to be adjacent to each other in the y-direction (e.g., the column direction).

Although FIG. 5 shows that the first group of the second pixel circuits PC2-G1 includes two second pixel circuits PC2, and the first group of the second display elements DE2-G1 includes two second display elements DE2, the present disclosure is not limited thereto, and the first group of the second pixel circuits PC2-G1 may include n second pixel circuits PC2, and the first group of the second display elements DE2-G1 may include n second display elements DE2, where n is a natural number equal to or greater than 1.

Further, although FIG. 5 shows that the second pixel circuits PC2 are arranged into four groups PC2-G1, PC2-G2, PC2-G3, and PC2-G4, and the second display elements DE2 are arranged into four groups DE2-G1, DE2-G2, DE2-G3, and DE2-G4, the present disclosure is not limited thereto, and each of the second pixel circuits PC2 and the second display elements DE2 may form (e.g., may be arranged into) two, three, five, or more groups.

As described above, the first scan driving circuit SDRV1 and the second scan driving circuit SDRV2 may be located at (e.g., in or on) the non-display area NDA. The first scan driving circuit SDRV1 may be located at (e.g., in or on) a left portion of the non-display area NDA, and the second scan driving circuit SDRV2 may be located at (e.g., in or on) a right portion of the non-display area NDA. Because the first scan driving circuit SDRV1 and the second scan driving circuit SDRV2 are symmetrically or substantially symmetrically located at (e.g., in or on) opposite sides of the first display area DA1, and may have the same or substantially the same configuration and function as each other, for convenience of description, the first scan driving circuit SDRV1 may be mainly described in more detail hereinafter, and redundant description with respect to the second scan driving circuit SDRV2 may not be repeated.

The first scan driving circuit SDRV1 may include a plurality of first stages ST1. The plurality of first stages ST1 may be electrically connected to a plurality of rows of the plurality of first pixel circuits PC1 that are arranged in the same row as each other through a plurality of first scan lines SL1 extending in the x-direction at (e.g., in or on) the first display area DA1, respectively. Accordingly, the plurality of first stages ST1 may each apply a scan signal to corresponding ones of the first pixel circuits PC1 that are arranged in the same row as each other through a corresponding first scan line SL1.

The first scan driving circuit SDRV1 may further include a second stage ST2. The second stage ST2 may be electrically connected to the second pixel circuits PC2 that are arranged in one row through the second scan line SL2 extending in the x-direction at (e.g., in or on) the non-display area NDA. Accordingly, the second stage ST2 may apply a scan signal to the second pixel circuits PC2 through the second scan line SL2.

According to an embodiment, because the plurality of second pixel circuits PC2 are arranged in one row at (e.g., in or on) the non-display area NDA, an increase in a thickness of a dead space in the y-direction may be reduced or minimized. Also, because one stage may be used in order to apply a scan signal to the plurality of second pixel circuits PC2, an area occupied by the first scan driving circuit SDRV1 may be reduced or minimized. Further, because one scan line extending in the x-direction at (e.g., in or on) the non-display area NDA is additionally provided, a complicated arrangement of the scan lines may be avoided. Accordingly, a dead space of the display apparatus 10 may be reduced or minimized, and the area of the display area may be increased or maximized.

The second scan line SL2 may be spaced apart from the plurality of first scan lines SL1 in the y-direction. An extension length L2 of the second scan line SL2 in the x-direction may be less than an extension length L1 of the first scan line SL1 in the x-direction. In an embodiment, in order to increase or maximize a light transmittance of the second display area DA2, the number of the second display elements DE2 located at (e.g., in or on) the second display area DA2 may be decreased or minimized. In this case, the number of the second pixel circuits PC2 forming one row may be less than the number of the first pixel circuits PC1 forming one row. Accordingly, the second scan line SL2 that applies a scan signal to the second pixel circuits PC2 may have an extension length L2 that is less than the extension length L1 of the first scan line SL1 that applies a scan signal to the first pixel circuits PC1.

A first start signal line SSL1, a first clock signal line CL1, a second start signal line SSL2, and a second clock signal line CL2 may be located at (e.g., in or on) the non-display area NDA. The first start signal line SSL1 and the first clock signal line CL1 may be located outside of the first scan driving circuit SDRV1, and the second start signal line SSL2 and the second clock signal CL2 may be located outside of the second scan driving circuit SDRV2. Because the arrangements and functions of the second start signal line SSL2 and the second clock signal line CL2 may be the same or substantially the same as (or similar to) those of the first start signal line SSL1 and the first clock signal line CL1, respectively, the same or substantially the same description of the first start signal line SSL1 and the first clock signal line CL1 may be applied to the second start signal line SSL2 and the second clock signal line CL2, and thus, redundant description with respect to the second start signal line SSL2 and the second clock signal line CL2 may not be repeated.

The first start signal line SSL1 may be connected to the second stage ST2 of the first scan driving circuit SDRV1. The first start signal line SSL1 may extend (e.g., may entirely or substantially extend) in the y-direction, and may be bent such that the first start signal line SSL1 may partially extend in the x-direction to be connected to the second stage ST2. The first start signal line SSL1 may transmit a start signal received from the display driver 32 (e.g., see FIG. 3) to the second stage ST2.

The first clock signal line CL1 may be connected to each of the plurality of first stages ST1 and the second stage ST2 of the first scan driving circuit SDRV1. The first clock signal line CL1 may also extend (e.g., may entirely or substantially extend) in the y-direction, and may be partially bent such that the first clock signal line CL1 may be connected to each of the plurality of first stages ST1 and the second stage ST2. The first clock signal line CL1 may transmit a clock signal received from the display driver 32 to each of the plurality of first stages ST1 and the second stage ST2.

The data line DL may be located at (e.g., in or on) the first display area DA1, and may extend in the y-direction. One data line DL may be electrically connected to at least one first pixel circuit PC1 arranged along the y-direction (e.g., the column direction) from among the plurality of first pixel circuits PC1 located at (e.g., in or on) the first display area DA1.

In an embodiment, the data line DL may extend from the first display area DA1 to the non-display area NDA, and may be electrically connected to at least one second pixel circuit PC2 from among the plurality of second pixel circuits PC2 located at (e.g., in or on) the non-display area NDA. For example, the data line DL may be electrically connected to one second pixel circuit PC2*a*, and at least one first pixel circuit PC1*a* that is adjacent to the one second pixel circuit PC2*a* in the y-direction. The first pixel circuit PC1*a* and the second pixel circuit PC2*a* may be arranged in the same column as each other along the y-direction (e.g., the column direction). In this case, a data signal transmitted through the data line DL may include a data signal to be provided to the second pixel circuit PC2, considering (e.g., according to) a first image to be provided through the first display area DA1 as well as a second image to be provided through the second display area DA2.

As a comparative example, when the second pixel circuit PC2 for driving the second display elements DE2 of the second display area DA2 is not located to be adjacent to the first display area DA1, separate connection wirings may be needed or used to apply a data signal to the second pixel circuit PC2, thereby resulting in a complicated arrangement and a complicated configuration. However, according to an embodiment, because the data line DL that is connected to the first pixel circuit PC1 may also be used to apply a data signal to the second pixel circuit PC2, a wiring, a circuit arrangement, and/or a design thereof may be simplified.

Figure 6:
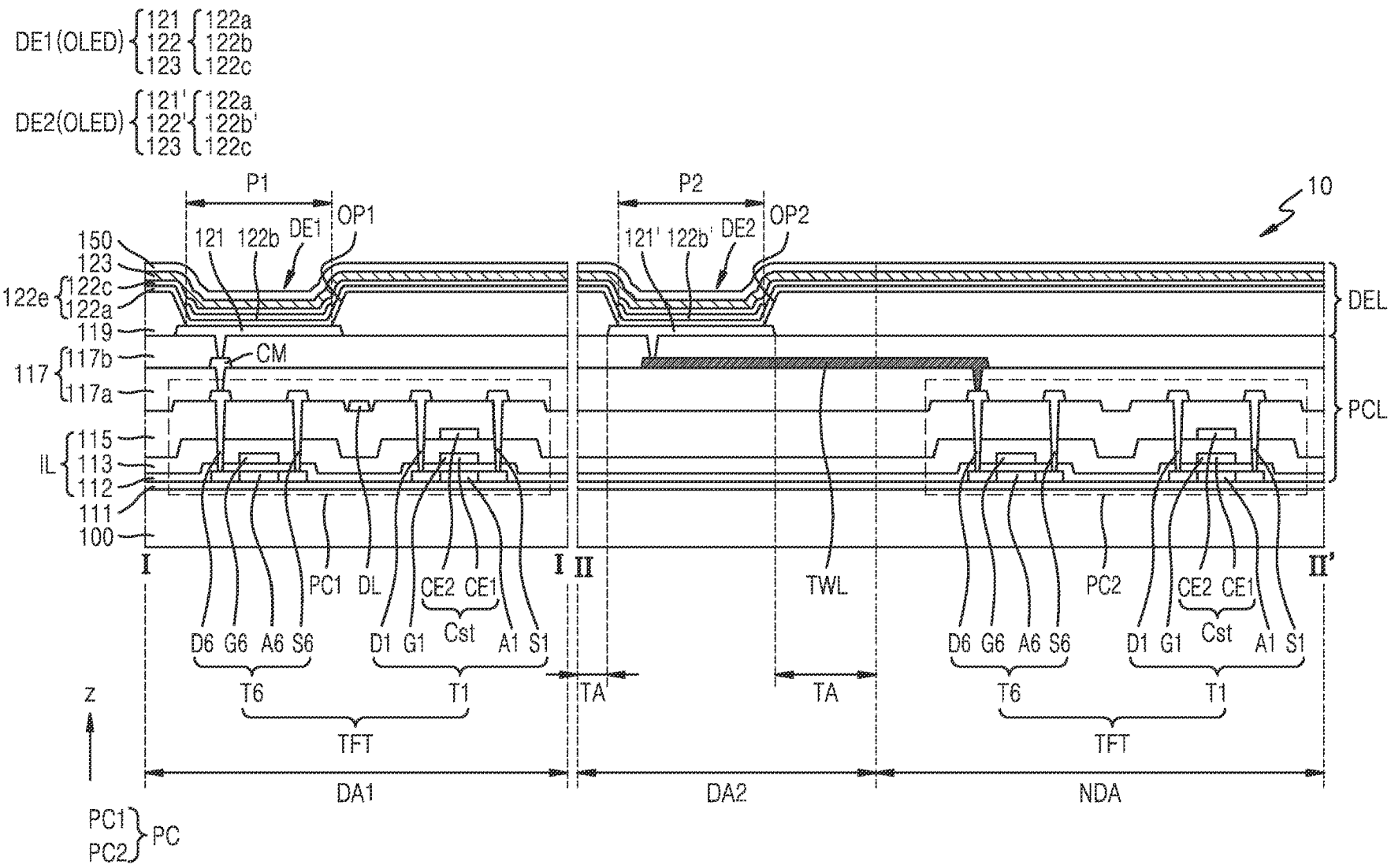
FIG. 6 is a cross-sectional view illustrating a part of the display apparatus of FIG. 5.

FIG. 6 is a cross-sectional view illustrating a part of the display apparatus of FIG. 5. FIG. 6 is a cross-sectional view taken along the lines I-I' and II-II' of the display apparatus of FIG. 5.

Referring to FIG. 6, the first display area DA1 may include the first pixel P1, and the second display area DA2 may include the second pixel P2 and the transmissive area TA. The first pixel circuit PC1 that includes a plurality of thin-film transistors TFT and a storage capacitor Cst, and an organic light emitting diode OLED that is the first display element DE1 electrically connected to the first pixel circuit PC1, may be located at (e.g., in or on) the first display area DA1. An organic light emitting diode OLED may be located at (e.g., in or on) the second display area DA2 as the second display element DE2. The second pixel circuit PC2 including a plurality of thin-film transistors TFT and a storage capacitor Cst may be located at (e.g., in or on) the non-display area NDA. The connection line TWL for connecting the second pixel circuit PC2 to the second display element DE2 may be located at (e.g., in or on) the second display area DA2 and the non-display area NDA.

Although the organic light emitting diode OLED is used as the display element in the present embodiment, the present disclosure is not limited thereto, and in another embodiment, an inorganic light emitting element or a quantum-dot light-emitting element may be used as the display element.

A stacked structure of the elements of the display apparatus 10 will now be described in more detail. The display apparatus 10 may have a stacked structure including the substrate 100, a buffer layer 111, the circuit layer PCL, and the display element layer DEL.

The substrate 100 may be formed of an insulating material, for example, such as glass, quartz, or a polymer resin. The substrate 100 may be a rigid substrate, or a flexible substrate that is bendable, foldable, and/or rollable.

The buffer layer 111 may be located on the substrate 100, and may reduce or prevent penetration of a foreign material, moisture, and/or external air from the bottom of the substrate 100. The buffer layer 111 may planarize or substantially planarize (e.g., a top surface of) the substrate 100. The buffer layer 111 may include an inorganic material, for example, such as an oxide or a nitride, an organic material, or a combination of an organic material and an inorganic material. The buffer layer 111 may have a single-layer structure, or a multi-layered structure including an inorganic material and an organic material. In some embodiments, a barrier layer may be further provided between the substrate 100 and the buffer layer 111 to prevent or reduce penetration of external air. In some embodiments, the buffer layer 111 may include silicon oxide ($SiO_2$) or silicon nitride ($SiN_x$).

The circuit layer PCL may be located on the buffer layer 111, and may include the pixel circuit PC, a first gate insulating layer 112, a second gate insulating layer 113, an interlayer insulating layer 115, and a planarization layer 117. The plurality of thin-film transistors TFT may be located on the buffer layer 111. Although the driving thin-film transistor T1 and the emission control thin-film transistor T6 from among the plurality of thin-film transistors TFT are illustrated in FIG. 6, the switching thin-film transistor T2, the compensation thin-film transistor T3, the first initialization thin-film transistor T4, the operation control thin-film transistor T5, and the second initialization thin-film transistor T7 may also be located on the buffer layer 111.

The driving thin-film transistor T1 may include a first semiconductor layer A1, a first gate electrode G1, a first source electrode S1, and a first drain electrode D1. The emission control thin-film transistor T6 may include a sixth semiconductor layer A6, a sixth gate electrode G6, a sixth source electrode S6, and a sixth drain electrode D6. The emission control thin-film transistor T6 may be connected to the first display element DE1 or the second display element DE2. For example, the emission control thin-film transistor T6 of the first pixel circuit PC1 may be connected to the first display element DE1, and the emission control thin-film transistor T6 of the second pixel circuit PC2 may be connected to the second display element DE2. Because the sixth semiconductor layer A6, the sixth gate electrode G6, the sixth source electrode S6, and the sixth drain electrode D6 of the emission control thin-film transistor T6 have the same or similar structure and/or configurations as those of the first semiconductor layer A1, the first gate electrode G1, the first source electrode S1, and the first drain electrode D1 of the driving thin-film transistor T1, for convenience of description, the driving thin-film transistor T1 may be described in more detail hereinafter.

The first semiconductor layer A1 may be located on the buffer layer 111, and may include polysilicon. In another embodiment, the first semiconductor layer A1 may include amorphous silicon. In another embodiment, the first semiconductor layer A1 may include an oxide of at least one material selected from the group consisting of indium (In), gallium (Ga), stannum (Sn), zirconium (Zr), vanadium (V), hafnium (Hf), cadmium (Cd), germanium (Ge), chromium (Cr), titanium (Ti), aluminum (Al), cesium (Cs), cerium (Ce), and zinc (Zn). The first semiconductor layer A1 may include a channel region, and a source region and a drain region located at (e.g., in or on) opposite sides of the channel region.

The first gate insulating layer 112 may be provided to cover the first semiconductor layer A1. The first gate insulating layer 112 may include an inorganic insulating material, for example, such as silicon oxide ($SiO_2$), silicon nitride ($SiN_x$), silicon oxynitride (SiON), aluminum oxide ($Al_2O_3$), titanium oxide ($TiO_2$), tantalum oxide ($Ta_2O_5$), hafnium oxide ($HfO_2$), or zinc oxide ($ZnO_2$). The first gate insulating layer 112 may have a single-layer structure or a multi-layered structure including one or more of the above inorganic insulating materials.

The first gate electrode G1 is located on the first gate insulating layer 112 to overlap with the first semiconductor layer A1. The first gate electrode G1 may include molybdenum (Mo), aluminum (Al), copper (Cu), or titanium (Ti), and may have a single-layer structure or a multi-layered structure. For example, the first gate electrode G1 may have a single-layer structure including Mo.

The second gate insulating layer 113 may be provided to cover the first gate electrode G1. The second gate insulating layer 113 may include an inorganic insulating material, for example, such as silicon oxide ($SiO_2$), silicon nitride ($SiN_x$), silicon oxynitride (SiON), aluminum oxide ($Al_2O_3$), titanium oxide ($TiO_2$), tantalum oxide ($Ta_2O_5$), hafnium oxide ($HfO_2$), or zinc oxide ($ZnO_2$). The second gate insulating layer 113 may have a single-layer structure or a multi-layered structure including one or more of the above inorganic insulating materials.

An upper electrode CE2 of the storage capacitor Cst may be located on the second gate insulating layer 113.

The upper electrode CE2 of the storage capacitor Cst may overlap with the first gate electrode G1 located under (e.g., underneath) the upper electrode CE2 at (e.g., in or on) the first display area DA1. The first gate electrode G1 and the upper electrode CE2 that overlaps with each other with the second gate insulating layer 113 therebetween may constitute (e.g., may form or may be included in) the storage capacitor Cst. In other words, the first gate electrode G1 may be (e.g., may function as) a lower electrode CE1 of the storage capacitor Cst.

The upper electrode CE2 may include aluminum (Al), platinum (Pt), palladium (Pd), silver (Ag), magnesium (Mg), gold (Au), nickel (Ni), neodymium (Nd), iridium (Ir), chromium (Cr), calcium (Ca), molybdenum (Mo), titanium (Ti), tungsten (W), and/or copper (Cu), and may have a single-layer structure or a multi-layered structure including one or more of the above materials.

The interlayer insulating layer 115 may be formed to cover the upper electrode CE2. The interlayer insulating layer 115 may include an inorganic insulating material, for example, such as silicon oxide ($SiO_2$), silicon nitride ($SiN_x$), silicon oxynitride (SiON), aluminum oxide ($Al_2O_3$), titanium oxide ($TiO_2$), tantalum oxide ($Ta_2O_5$), hafnium oxide ($HfO_2$), or zinc oxide ($ZnO_2$). The interlayer insulating layer 115 may have a single-layer structure or a multi-layered structure including one or more of the above inorganic insulating materials.

The first source electrode S1, the first drain electrode D1, and the data line DL may be located on the interlayer insulating layer 115. Each of the first source electrode S1 and the first drain electrode D1 may include a conductive material including molybdenum (Mo), aluminum (Al), copper (Cu), or titanium (Ti), and may have a single-layer structure or a multi-layered structure including one or more of the above materials. For example, each of the first source electrode S1 and the first drain electrode D1 may have a multi-layered structure including Ti/Al/Ti. The data line DL may include the same or substantially the same material as that of the first source electrode S1 and the first drain electrode D1.

The planarization layer 117 may be located to cover the first source electrode S1 and the first drain electrode D1. The planarization layer 117 may have a flat or substantially flat top surface, so that a first pixel electrode 121 and a second pixel electrode 121' that are located on the planarization layer 117 may be flat or substantially flat.

The planarization layer 117 may include an organic material or an inorganic material, and may have a single-layer structure or a multi-layered structure. For example, the planarization layer 117 may include a first planarization layer 117*a*, and a second planarization layer 117*b*. Accordingly, a conductive pattern, for example, such as a wiring, may be formed between the first planarization layer 117*a* and the second planarization layer 117*b*, which may lead to high integration. For example, a contact metal CM and the connection line TWL may be located on the first planarization layer 117*a*, and may be covered by the second planarization layer 117*b*.

The planarization layer 117 may include benzocyclobutene (BCB), polyimide, hexamethyldisiloxane (HMDSO), a general-purpose polymer, for example, such as polymethyl methacrylate (PMMA) or polystyrene (PS), a polymer derivative having a phenol-based group, an acrylic polymer, an imide-based polymer, an aryl ether-based polymer, an amide-based polymer, a fluorinated polymer, a p-xylene-based polymer, or a vinyl alcohol-based polymer. The planarization layer 117 may include an inorganic insulating material, for example, such as silicon oxide ($SiO_2$), silicon nitride ($SiN_x$), silicon oxynitride (SiON), aluminum oxide ($Al_2O_3$), titanium oxide ($TiO_2$), tantalum oxide ($Ta_2O_5$), hafnium oxide ($HfO_2$), or zinc oxide ($ZnO_2$). When the planarization layer 117 is formed, a layer thereof may be formed, and then chemical mechanical polishing may be performed on a top surface of the layer in order to provide a flat or substantially flat top surface.

The first planarization layer 117*a* may be located to cover the pixel circuit PC. The second planarization layer 117*b* may be located on the first planarization layer 117*a*, and may have a flat or substantially flat top surface so that the first and second pixel electrodes 121 and 121' thereon are flat or substantially flat.

The connection line TWL electrically connected to the second pixel circuit PC2 may be located on the first planarization layer 117*a*. The connection line TWL may extend from the non-display area NDA to the second display area DA2, to connect the second display element DE2 to the second pixel circuit PC2.

The connection line TWL may include a transparent conductive material. For example, the connection line TWL may include a transparent conductive oxide (TCO). The connection line TWL may include a conductive oxide, for example, such as indium tin oxide (ITO), indium zinc oxide (IZO), zinc oxide (ZnO), indium oxide ($In_2O_3$), indium gallium oxide (IGO), or aluminum zinc oxide (AZO). Accordingly, even though the connection line TWL is located at (e.g., in or on) the transmissive area TA, a decrease in a light transmittance of the transmissive area TA may be minimized or reduced.

The first and second display elements DE1 and DE2 may be located on the second planarization layer 117*b*. The first pixel electrode 121 of the first display element DE1 and the second pixel electrode 121' of the second display element DE2 may be connected to the first and second pixel circuits PC1 and PC2, respectively, through the contact metal CM and the connection line TWL located on the first planarization layer 117*a*.

Each of the first pixel electrode 121 and the second pixel electrode 121 may include a conductive oxide, for example, such as indium tin oxide (ITO), indium zinc oxide (IZO), zinc oxide (ZnO), indium oxide ($In_2O_3$), indium gallium oxide (IGO), or aluminum zinc oxide (AZO). Each of the first pixel electrode 121 and the second pixel electrode 121' may include a reflective film including silver (Ag), magnesium (Mg), aluminum (Al), platinum (Pt), palladium (Pd), gold (Au), nickel (Ni), neodymium (Nd), iridium (Ir), chromium (Cr), or a suitable compound thereof. For example, each of the first pixel electrode 121 and the second pixel electrode 121' may have a structure in which one or more films formed of ITO, IZO, ZnO, or $In_2O_3$ are located over and/or under the reflective film. In this case, for example, each of the first pixel electrode 121 and the second pixel electrode 121' may have a stacked structure including ITO/Ag/ITO.

A pixel-defining film 119 may be located on the planarization layer 117, and may cover edges of the first pixel electrode 121 and the second pixel electrode 121'. For example, the pixel-defining film 119 may have a first opening OP1 and a second opening OP2 through which central portions of the first pixel electrode 121 and the second pixel electrode 121' are exposed. A size and a shape of the emission areas of the organic light emitting diodes OLED, or in other words, the pixels P, are defined by the first opening OP1 and the second opening OP2.

The pixel-defining film 119 may increase a distance between the edges of the first and second pixel electrodes 121 and 121' and a counter electrode 123 located over the first and second pixel electrodes 121 and 121', which may prevent or substantially prevent an arc or the like from occurring on the edges of the first and second pixel electrodes 121 and 121'. The pixel-defining film 119 may be formed of an organic insulating material, for example, such as polyimide, polyamide, acrylic resin, benzocyclobutene, hexamethyldisiloxane (HMDSO), or phenolic resin, by using spin coating or the like.

A first emission layer 122*b* and a second emission layer 122*b'* are located in the first opening OP1 and the second opening OP2 of the pixel-defining film 119 to correspond to the first pixel electrode 121 and the second pixel electrode 121', respectively. Each of the first emission layer 122*b* and the second emission layer 122*b'* may include a high molecular weight material or a low molecular weight material, and may emit any suitable colored light, for example, such as a red light, a green light, a blue light, or a white light.

An organic functional layer 122*e* may be located over and/or under the first emission layer 122*b* and the second emission layer 122*b'*. The organic functional layer 122*e* may include a first functional layer 122*a* and/or a second functional layer 122*c*. However, the present disclosure is not limited thereto, and the first functional layer 122*a* or the second functional layer 122*c* may be omitted as needed or desired.

The first functional layer 122*a* may be located under (e.g., underneath) the first emission layer 122*b* and the second emission layer 122*b'*. The first functional layer 122*a* may have a single-layer structure or a multi-layered structure including an organic material. For example, the first functional layer 122*a* may be a hole transport layer (HTL) having a single-layer structure. As another example, the first functional layer 122*a* may include a hole injection layer (HIL)

and a hole transport layer (HTL). The first functional layer 122*a* may be integrally formed to correspond to the first display elements DE1 and the second display elements DE2 that are located at (e.g., in or on) the first display area DA1 and the second display area DA2, respectively.

The second functional layer 122*c* may be located over the first emission layer 122*b* and the second emission layer 122*b*'. The second functional layer 122*c* may have a single-layer structure or a multi-layered structure including an organic material. The second functional layer 122*c* may include an electron transport layer (ETL) and/or an electron injection layer (EIL). The second functional layer 122*c* may be integrally formed to correspond to the first display elements DE1 and the second display elements DE2 located at (e.g., in or on) the first display area DA1 and the second display area DA2, respectively.

The counter electrode 123 is located on the second functional layer 122*c*. The counter electrode 123 may include a conductive material having a low work function. For example, the counter electrode 123 may include a transparent or a semi-transparent layer including silver (Ag), magnesium (Mg), aluminum (Al), platinum (Pt), palladium (Pd), gold (Au), nickel (Ni), neodymium (Nd), iridium (Ir), chromium (Cr), lithium (Li), calcium (Ca), or a suitable alloy thereof. As another example, the counter electrode 123 may further include a layer formed of ITO, IZO, ZnO, or $In_2O_3$ on the transparent or semi-transparent layer including one or more of the above materials. The counter electrode 123 may be integrally formed to correspond to the first display elements DE1 and the second display elements DE2 located at (e.g., in or on) the first display area DA1 and the second display area DA2, respectively.

The layers from the first pixel electrode 121 to the counter electrode 123 formed at (e.g., in or on) the first display area DA1 may constitute (e.g., may be included in or may form) the organic light emitting diode OLED that is the first display element DE1. The layers from the second pixel electrode 121' to the counter electrode 123 formed at (e.g., in or on) the second display area DA2 may constitute (e.g., may be included in or may form) the organic light emitting diode OLED that is the second display element DE2.

An upper layer 150 including an organic material may be formed on the counter electrode 123. The upper layer 150 may protect the counter electrode 123, and may improve a light extraction efficiency. For example, the upper layer 150 may include an organic material having a refractive index that is higher than that of the counter electrode 123. As another example, the upper layer 150 may be formed by stacking various layers having different refractive indexes from one another. For example, the upper layer 150 may be formed by stacking a high refractive index layer, a low refractive index layer, and a high refractive index layer on one another. In this case, a refractive index of the high refractive index layer may be equal to or substantially equal to, or greater than, 1.7 (e.g., about 1.7), and a refractive index of the low refractive index layer may be equal to or substantially equal to, or less than, 1.3 (e.g., about 1.3).

The upper layer 150 may additionally include LiF. As another example, the upper layer 150 may additionally include an inorganic insulating material, for example, such as silicon oxide ($SiO_2$) or silicon nitride ($SiN_x$).

Figure 7:
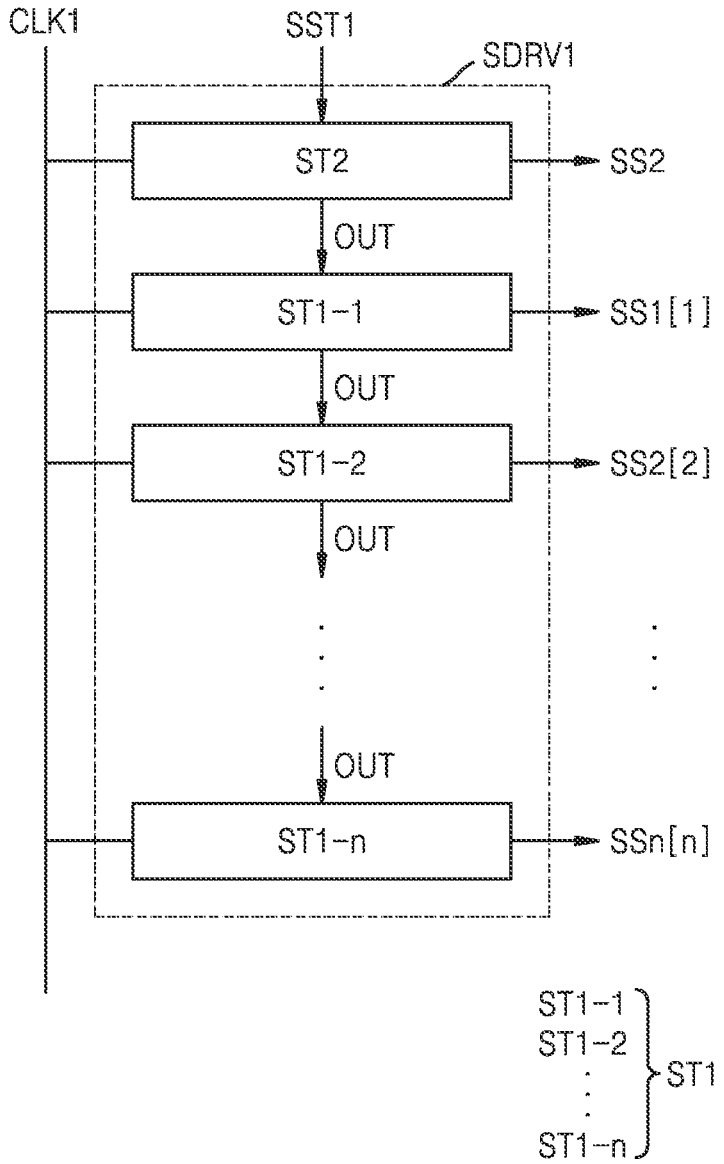
FIG. 7 is a block diagram illustrating a scan driving circuit of the display apparatus of FIG. 5.

FIG. 7 is a block diagram illustrating a scan driving circuit of the display apparatus of FIG. 5. FIG. 7 may correspond to the first scan driving circuit SDRV1 of FIG. 5. The first scan driving circuit SDRV1 is described in more detail for convenience of description, and the same or substantially the same description of the first scan driving circuit SDRV1 may be applied to the second scan driving circuit SDRV2, and thus, redundant description with respect to the second scan driving circuit SDRV2 may not be repeated.

Referring to FIG. 7, the first scan driving circuit SDRV1 may include the second stage ST2, and the plurality of first stages ST1, which are connected to one another in cascade. The second stage ST2 may output a second scan signal SS2. The plurality of first stages ST1 may output first scan signals SS1[1], SS1[2], . . . , and SS1[*n*], respectively, where n may be an integer, and a number of the plurality of first stages ST1 may correspond to a total number of rows of the first pixels P1 located at (e.g., in or on) the first display area DA1 (e.g., see FIG. 5).

The second stage ST2 may receive a first start signal SST1 and a first clock signal CLK1, and may output the second scan signal SS2 in response to the first start signal SST1. A first first stage ST1-1 from among the plurality of first stages ST1 may receive a carry signal OUT as a start signal from the second stage ST2, and may output a first first scan signal SS1[1] in response to the carry signal OUT. Similarly, the other remaining first stages ST1-2, . . . , and ST1-*n*, other than the first first stage ST1-1, may receive carry signals OUT as start signals from previous first stages ST1.

The second scan signal SS2 output from the second stage ST2 may be applied to the second pixel circuit PC2 forming one row through the second scan line SL2 (e.g., see FIG. 5). The first scan signals SS1[1], SS1[2], . . . , and SS1[*n*] that are sequentially output from the plurality of first stages ST1 may be applied to the first pixel circuits PC1 of the plurality of rows through the first scan lines SL1 (e.g., see FIG. 5), respectively.

Figure 8:
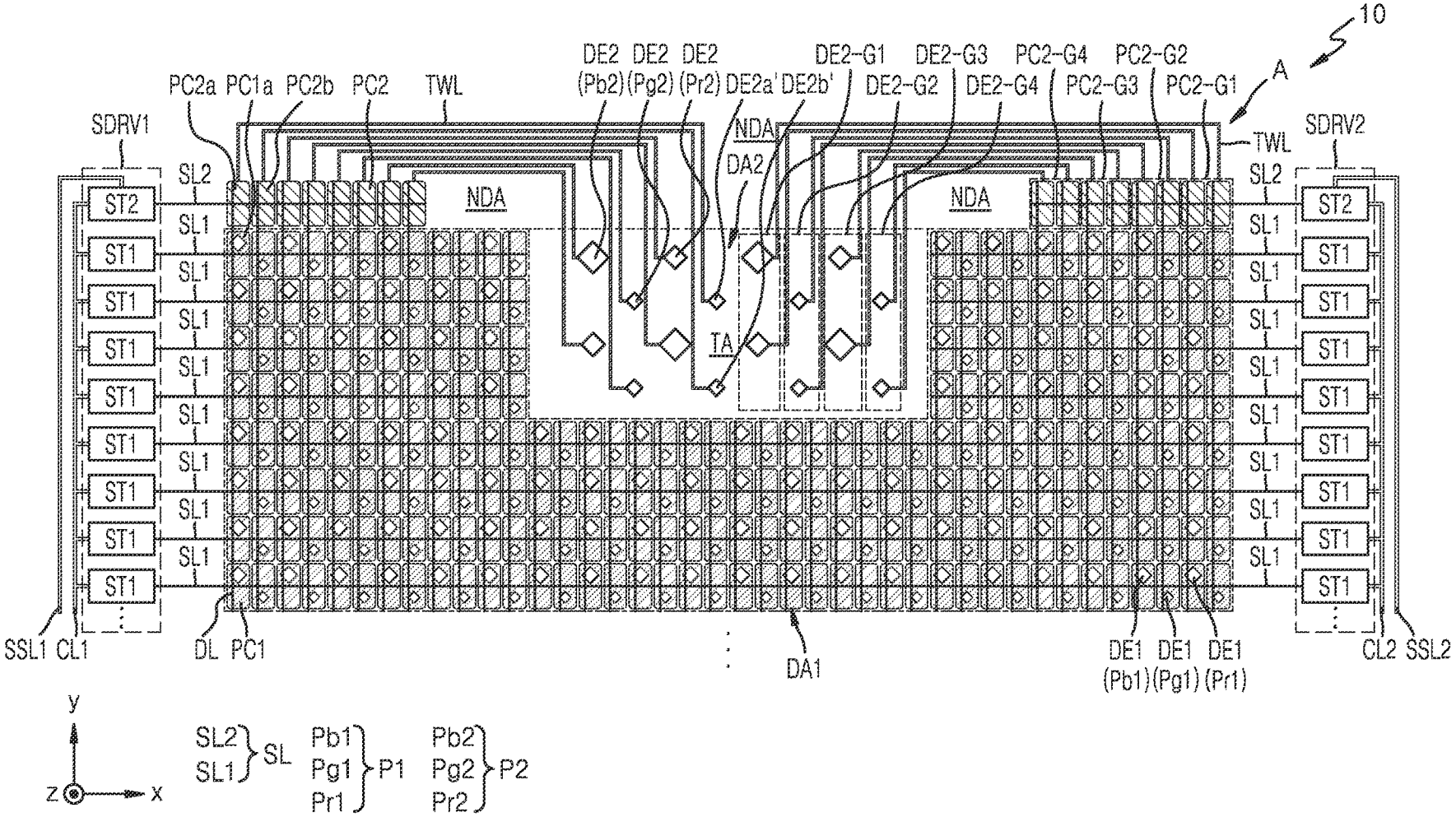
FIG. 8 is a plan view illustrating a portion of a display apparatus according to another embodiment.

FIG. 8 is a plan view illustrating a portion of a display apparatus according to another embodiment. Redundant description of the same or substantially the same (or similar) elements, layers, and configurations as those described with reference to FIG. 5 may not be repeated, and the differences therebetween may be mainly described in more detail hereinafter.

Referring to FIG. 8, two second pixel circuits PC2*a* and PC2*b* that are adjacent to each other in the x-direction (e.g., the row direction) from among the plurality of second pixel circuits PC2 located at (e.g., in or on) the non-display area NDA may be electrically connected through the connection lines TWL to two second display elements DE2*a*' and DE2*b*' that are arranged to be adjacent to each other in the y-direction (e.g., the column direction) at (e.g., in or on) the second display area DA2, respectively.

In this case, a first group of second pixel circuits PC2-G1 including second pixel circuits PC2 that are sequentially arranged along the x-direction (e.g., the row direction) from among the plurality of second pixel circuits PC2 located at (e.g., in or on) the non-display area NDA may be respectively electrically connected through the connection lines TWL to a first group of second display elements DE2-G1 including second display elements DE2 that are sequentially arranged along the y-direction (e.g., the column direction) at (e.g., in or on) the second display area DA2. Similarly, a second group of pixel circuits PC2-G2 may be respectively electrically connected to a second group of second display elements DE2-G2, a third group of pixel circuits PC2-G3 may be respectively electrically connected to a third group of second display elements DE2-G3, and fourth group of pixel circuits PC2-G4 may be respectively electrically connected to a fourth group of second pixel elements DE2-G4.

In an embodiment, the first group of the pixel circuits PC2-G1 and the second group of the pixel circuits PC2-G2 may be arranged to be adjacent to each other in the x-direction (e.g., the row direction). The first group of the second display elements DE2-G1 and the second group of the second display elements DE2-G2 may be arranged to be adjacent to each other in the x-direction (e.g., the row direction).

Although FIG. 8 shows that the first group of the second pixel circuits PC2-G1 includes two second pixel circuits PC2, and the first group of the second display elements DE2-G1 includes two second display elements DE2, the present disclosure is not limited thereto, and the first group of the second pixel circuits PC2-G1 may include n second pixel circuits PC2, and the first group of the second display elements DE2-G1 may include n second display elements DE2, where n is a natural number equal to or greater than 1.

Further, although FIG. 8 shows that the second pixel circuits PC2 are arranged as four groups, and the second display elements DE2 are arranged as four groups, the present disclosure is not limited thereto, and each of the second pixel circuits PC2 and the second display elements DE2 may form (e.g., may be arranged into) two, three, five, or more groups.

In the present embodiment, a data signal transmitted through the data line DL may be determined in consideration of an arrangement and a corresponding relationship between the second pixel circuits PC2 and the second display elements DE2.

Figure 9:
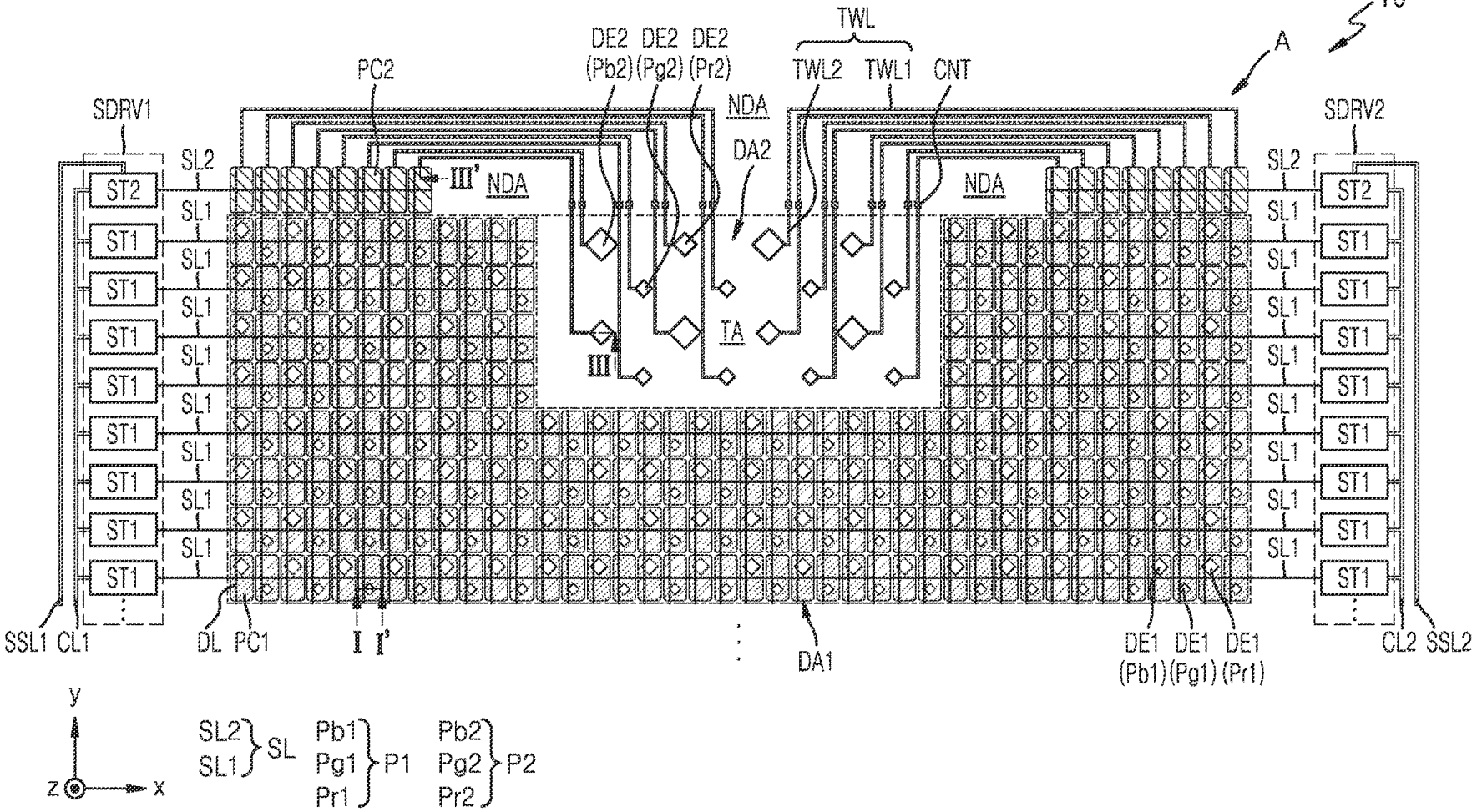
FIG. 9 is a plan view illustrating a portion of a display apparatus according to another embodiment.

FIG. 9 is a plan view illustrating a portion of a display apparatus according to another embodiment. Redundant description of the same or substantially the same (or similar) elements, layers, and configurations as those described with reference to FIGS. 5 and 8 may not be repeated, and the differences therebetween may be mainly described in more detail hereinafter.

Referring to FIG. 9, at least one of the plurality of connection lines TWL may include a first portion TWL1 located at (e.g., in or on) the non-display area NDA, and a second portion TWL2 located at (e.g., in or on) the second display area DA2. The first portion TWL1 and the second portion TWL2 may include different materials from each other. For example, the first portion TWL1 may include a conductive material including molybdenum (Mo), aluminum (Al), copper (Cu), or titanium (Ti), and may have a single-layer structure or a multi-layered structure including one or more of the above materials. The second portion TWL2 may include a transparent conductive material. For example, the second portion TWL2 may include a transparent conductive oxide (TCO). The connection line TWL may include a conductive oxide, for example, such as indium tin oxide (ITO), indium zinc oxide (IZO), zinc oxide (ZnO), indium oxide ($In_2O_3$), indium gallium oxide (IGO), or aluminum zinc oxide (AZO).

The first portion TWL1 of the connection line TWL may have a conductivity that is higher than that of the second portion TWL2. Because the first portion TWL1 is located at (e.g., in or on) the non-display area NDA, and thus, may not need to secure a light transmittance, the first portion TWL1 may include a material having a lower light transmittance and a higher conductivity than those of the second portion TWL2. Accordingly, a resistance value of the connection line TWL may be reduced or minimized.

Figure 10:
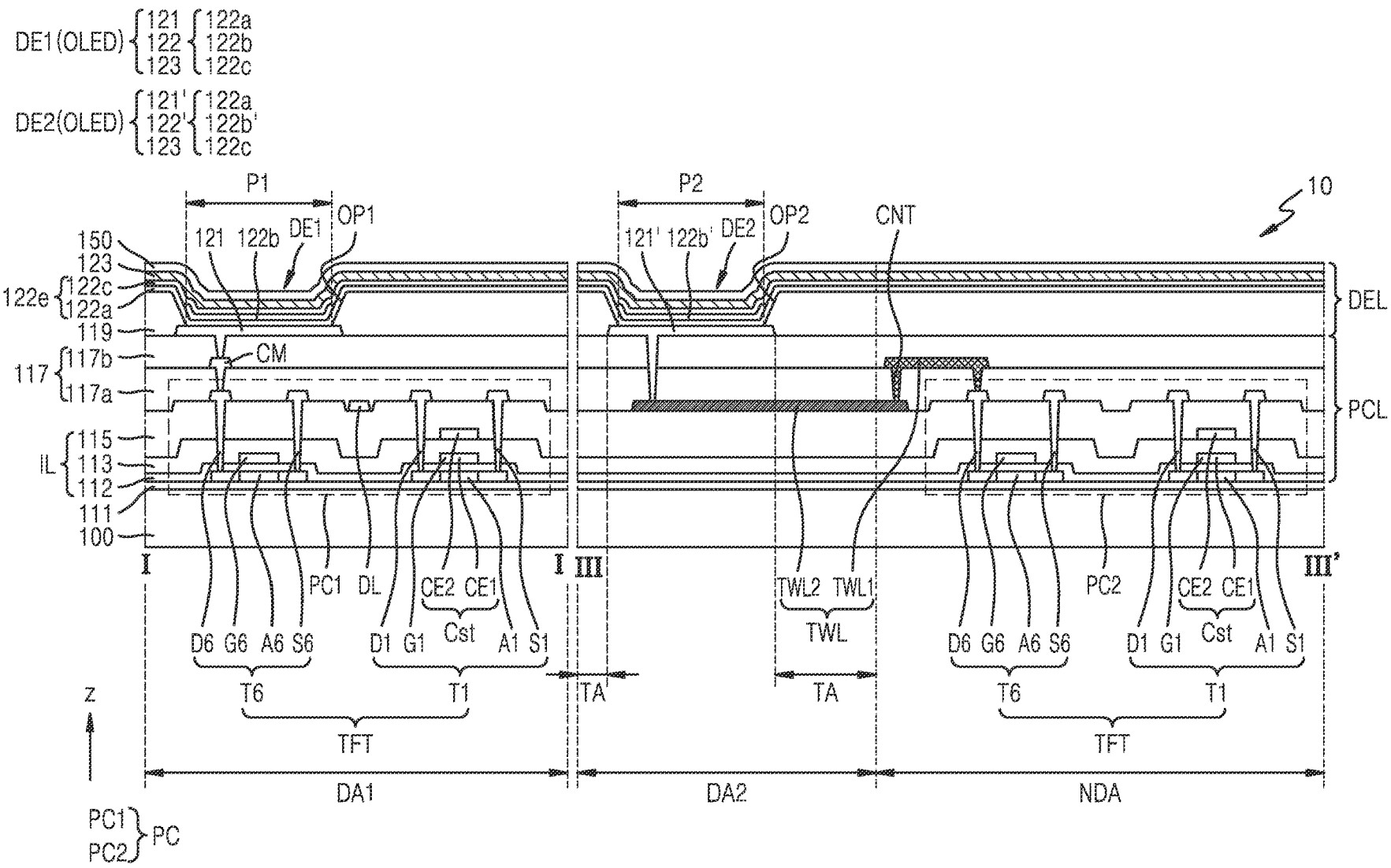
FIG. 10 is a cross-sectional view illustrating a part of the display apparatus of FIG. 9.

FIG. 10 is a cross-sectional view illustrating a part of the display apparatus of FIG. 9. FIG. 10 is a cross-sectional view taken along the lines I-I' and III-III' of the display apparatus of FIG. 9. Redundant description of the same or substantially the same (or similar) elements, layers, and configurations as those described with reference to FIG. 6 may not be repeated, and the differences therebetween may be mainly described in more detail hereinafter.

Referring to FIG. 10, the first portion TWL1 and the second portion TWL2 of the connection line TWL may be located at (e.g., in or on) different layers from each other. For example, the first portion TWL1 of the connection line TWL may be located on the first planarization layer 117*a* at (e.g., in or on) the non-display area NDA, and the second portion TWL2 may be located on the interlayer insulating layer 115 at (e.g., in or on) the second display area DA2. The first portion TWL1 and the second portion TWL2 of the connection line TWL may contact each other through a contact hole CNT formed in the first planarization layer 117*a* that is located between the first portion TWL1 and the second portion TWL2.

Figure 11:
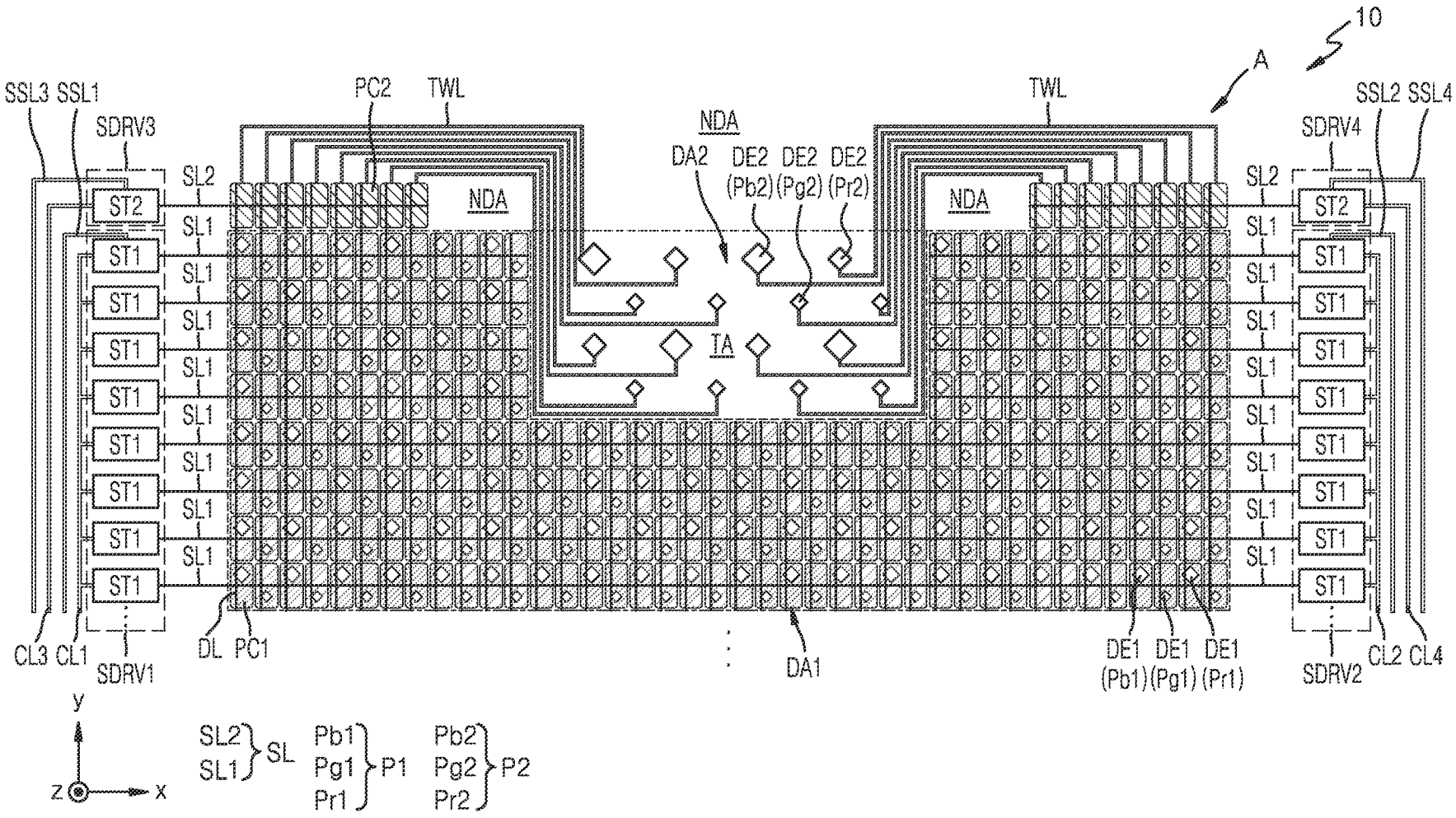
FIG. 11 is a plan view illustrating a portion of a display apparatus according to another embodiment.

FIG. 11 is a plan view illustrating a portion of a display apparatus according to another embodiment. Redundant description of the same or substantially the same (or similar) elements, layers, and configurations as those described with reference to FIG. 5 may not be repeated, and the differences therebetween may be mainly described in more detail hereinafter.

Referring to FIG. 11, the display apparatus 10 may include first through fourth scan driving circuits SDRV1, SDRV2, SDRV3, and SDRV4 located at (e.g., in or on) the non-display area NDA. The first and third scan driving circuits SDRV1 and SDRV3 may be located at (e.g., in or on) a left portion of the non-display area NDA, and the second and fourth scan driving circuits SDRV2 and SDRV4 may be located at (e.g., in or on) a right portion of the non-display area NDA. Because the first scan driving circuit SDRV1 and the third scan driving circuit SDRV3 may be symmetrically or substantially symmetrically located at an opposite side of the first display area DA1 than that of the second scan driving circuit SDRV2 and the fourth scan driving circuit SDRV4, and have the same or substantially the same configuration and function as those of the second scan driving circuit SDRV2 and the fourth scan driving circuit SDRV4, for convenience of description, the first scan driving circuit SDRV1 and the third scan driving circuit SDRV3 may be mainly described in more detail hereinafter, and redundant description with respect to the second scan driving circuit SDRV2 and the fourth scan driving circuit SDRV4 may not be repeated.

The first scan driving circuit SDRV1 may include a plurality of first stages ST1. The plurality of first stages ST1 may be electrically connected to a plurality of rows of the first pixel circuits PC1 that are arranged in the same row as each other through a plurality of first scan lines SL1 extending in the x-direction at (e.g., in or on) the first display area DA1, respectively. Accordingly, the plurality of first stages ST1 may each apply a scan signal to corresponding ones of the first pixel circuits PC1 that are arranged in the same row as each other through a corresponding first scan line SL1.

The third scan driving circuit SDRV3 may include the second stage ST2. The second stage ST2 may be electrically connected to the second pixel circuits PC2 that are arranged in one row through the second scan line SL2 extending in the x-direction at (e.g., in or on) the non-display area NDA. Accordingly, the second stage ST2 may apply a scan signal to the second pixel circuits PC2 through the second scan line SL2. In an embodiment, the first scan driving circuit SDRV1 and the third scan driving circuit SDRV3 may be arranged along the y-direction.

The display apparatus 10 may include first through fourth start signal lines SSL1, SSL2, SSL3, and SSL4, and first through fourth clock signal lines CL1, CL2, CL3, and CL4, which are located at (e.g., in or on) the non-display area NDA.

The first and third start signal lines SSL1 and SSL3 may be located outside the first and third scan driving circuits SDRV1 and SDRV3. The first start signal line SSL1 may be connected to a first stage ST1 from among the plurality of first stages ST1 of the first scan driving circuit SDRV1. The third start signal line SSL3 may be connected to the second stage ST2 of the third scan driving circuit SDRV3. In other words, a start signal line of the first scan driving circuit SDRV1 and a start signal line of the third scan driving circuit SDRV3 may be spaced apart (e.g., may be separated) from each other.

The first and third clock signal lines CL1 and CL3 may be located outside the first and third scan driving circuits SDRV1 and SDRV3. The first clock signal line CL1 may be connected to the plurality of first stages ST1 of the first scan driving circuit SDRV1. The third clock signal line CL3 may be connected to the second stage ST2 of the third scan driving circuit SDRV3.

Accordingly, the second display elements DE2 may be driven independently from the first display elements DE1. In more detail, because the third scan driving circuit SDRV3 applies a scan signal to the second pixel circuits PC2, and the third start signal line SSL3 and the third clock signal line CL3 that are connected to the third scan driving circuit SDRV3 are separately provided, a scan signal may be applied to the second pixel circuits PC2 that is independent of a scan signal that is applied to the first pixel circuits PC1. In this case, a scan direction of the first pixel circuits PC1 and a scan direction of the second pixel circuits PC2 may be differently set from each other, for example, by independently setting a timing of the start signal. As such, characteristics of a scan signal applied to the second pixel circuits PC2 may be independently determined, and thus, emission characteristics, for example, such as an emission time and the like, of the second display elements DE2 driven by the second pixel circuits PC2 may be independently controlled. Further, the second pixel circuit PC2 may have a circuit configuration that is different from that of the first pixel circuit PC1 when necessary or desired. For example, the second pixel circuit PC2 may include three thin-film transistors and two storage capacitors.

The arrangements and functions of the second and fourth start signal lines SSL2 and SSL4 are the same or substantially the same as (or similar to) those of the first and third start signal lines SSL1 and SSL3, and the arrangements and functions of the second and fourth clock signal lines CL2 and CL4 are the same or substantially the same as (or similar to) those of the first and third clock signal lines CL1 and CL3. Accordingly, the same or substantially the same (or similar) description of the first and third start signal lines SSL1 and SSL3 and the first and third clock signal lines CL1 and CL3 may be applied to the second and fourth start signal lines SSL2 and SSL4 and the second and fourth clock signal lines CL2 and CL4.

Figure 12:
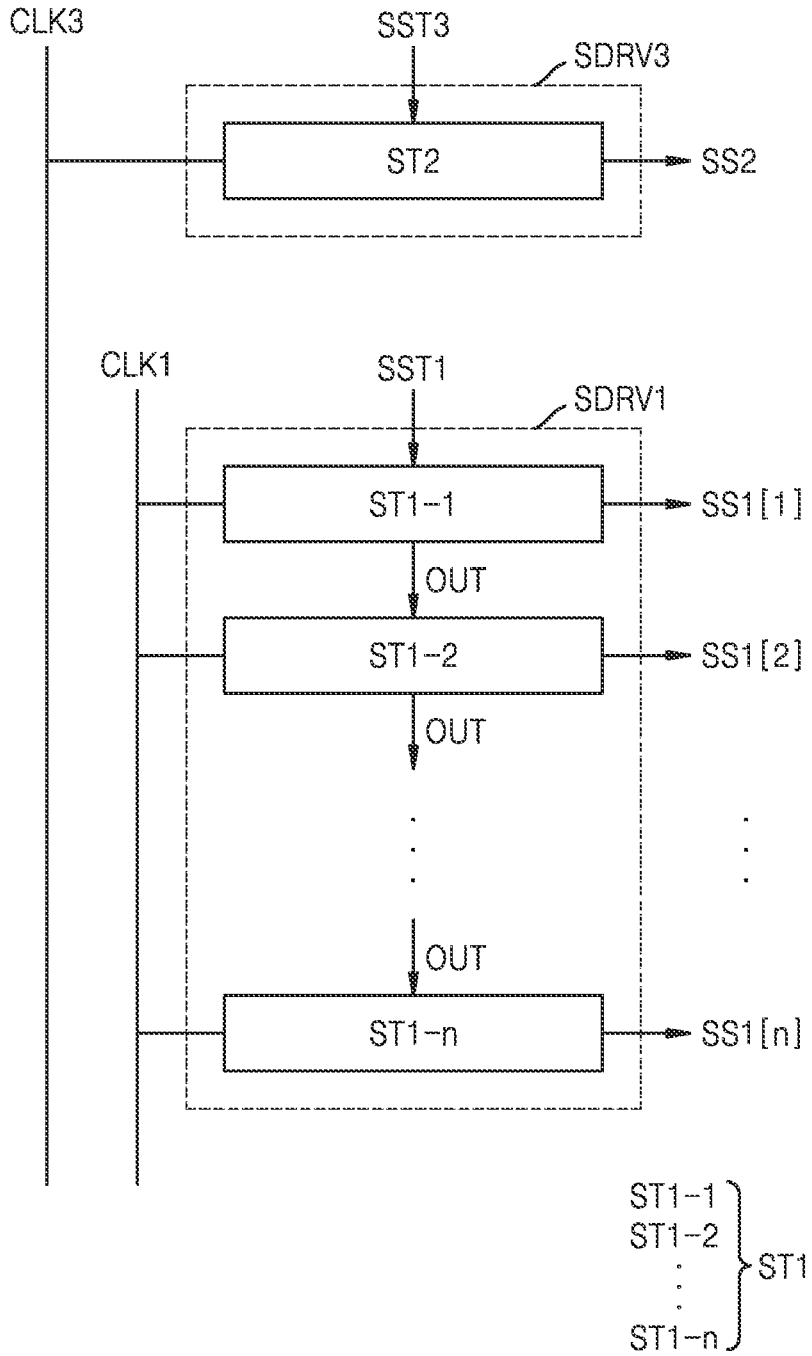
FIG. 12 is a block diagram illustrating a scan driving circuit of the display apparatus of FIG. 11.

FIG. 12 is a block diagram illustrating a scan driving circuit of the display apparatus of FIG. 11. Redundant description of the same or substantially the same (or similar) elements, layers, and configurations as those described with reference to FIG. 7 may not be repeated, and the differences therebetween may be mainly described in more detail hereinafter.

Referring to FIG. 12, the first scan driving circuit SDRV1 may include the plurality of first stages ST1 that are connected to one another in cascade. The plurality of first stages ST1 may output first scan signals SS1[1], SS1[2], . . . , and SS1[*n*], respectively, where n may be an integer.

The first first stage ST1-1 from among the plurality of first stages ST1 may receive a first start signal SST1 and a first clock signal CLK1, and may output the first first scan signal SS1[1] in response to the first start signal SST1. The other remaining first stages ST1-2, . . . , and ST1-*n*, other than the first first stage ST1-1, may receive carry signals OUT as start signals from previous first stages ST1. In response to the carry signals OUT, the other remaining first stages ST1-2, . . . , and ST1-*n* may sequentially output the first scan signals SS1[2], . . . , and SS1[*n*].

The third scan driving circuit SDRV3 may include the second stage ST2. The second stage ST2 may receive a third start signal SST3 and a third clock signal CLK3, and may output a second scan signal SS2 in response to the third start signal SST3. The third start signal SST3 and the third clock signal CLK3 may be set differently from the first start signal SST1 and the first clock signal CLK1, and thus, the second scan signal SS2 that is a scan signal independent of the first scan signal SS1 may be applied to the second pixel circuit PC2. Accordingly, an emission time and an emission timing of the second display element DE2 may be controlled independently from those of the first display element DE1 when necessary or desired.

Although a display apparatus and an electronic device including the display apparatus have been mainly described, the present disclosure is not limited thereto. For example, a method of manufacturing the display apparatus may also be within the scope of the present disclosure.

According to the one or more embodiments, a display apparatus in which a display area is extended to display an image even at (e.g., in or on) an area where an electronic component is located, and an electronic device including the display apparatus, may be provided. For example, a display apparatus may be provided in which a light transmittance of an area where an electronic component is located may be increased, and the area of a dead space of a non-display area may be reduced or minimized, and an electronic device including the display apparatus may be provided. However, the present disclosure is not limited to the above aspects and features.

Although some embodiments have been described, those skilled in the art will readily appreciate that various modifications are possible in the embodiments without departing from the spirit and scope of the present disclosure. It will be understood that descriptions of features or aspects within each embodiment should typically be considered as available for other similar features or aspects in other embodiments, unless otherwise described. Thus, as would be apparent to one of ordinary skill in the art, features, characteristics, and/or elements described in connection with a particular embodiment may be used singly or in combination with features, characteristics, and/or elements described in connection with other embodiments unless otherwise specifically indicated. Therefore, it is to be understood that the foregoing is illustrative of various embodiments and is not to be construed as limited to the specific embodiments disclosed herein, and that various modifications to the disclosed embodiments, as well as other embodiments, are intended to be included within the spirit and scope of the present disclosure as defined in the appended claims, and their equivalents.

What is claimed is:

1. A display apparatus comprising:

a first display area, a second display area, and a non-display area surrounding the first display area and the second display area;

a plurality of first display elements at the first display area;

a plurality of first pixel circuits at the first display area, and electrically connected to the plurality of first display elements, respectively;

a plurality of second display elements at the second display area;

a plurality of second pixel circuits located along a first direction, and electrically connected to the plurality of second display elements, respectively; and a data line electrically connected to at least one first pixel circuit from among the plurality of first pixel circuits that is located along a second direction crossing the first direction at the first display area, and to at least one second pixel circuit from among the plurality of second pixel circuits, wherein the plurality of second pixel circuits is spaced from the plurality of second display elements in a plan view and the data line is located at the first display area.

2. The display apparatus of claim 1, wherein a portion of the data line is located at the first display area.

3. The display apparatus of claim 1, wherein the data line extends in the second direction.

4. The display apparatus of claim 1, wherein the plurality of second pixel circuits is located along the first direction in rows.

5. The display apparatus of claim 1, wherein the plurality of second pixel circuits is located at an area that is adjacent to the plurality of first pixel circuits.

6. The display apparatus of claim 1, wherein at least one of the plurality of first pixel circuits and at least one of the plurality of first display elements overlap with each other.

7. The display apparatus of claim 1, further comprising:

a plurality of first scan lines extending in the first direction at the first display area, and electrically connected to a plurality of rows of the plurality of first pixel circuits, respectively.

8. The display apparatus of claim 1, further comprising a plurality of connection lines configured to electrically connect the plurality of second display elements to the plurality of second pixel circuits, respectively.

9. The display apparatus of claim 8, wherein a portion of at least one of the connection lines comprises a transparent conductive oxide.

10. The display apparatus of claim 8, wherein a portion of at least one of the connection lines is located at the second display area and extends in the first direction.

11. An electronic device comprising:

a display apparatus comprising:

a first display area;

a second display area comprising a transmissive area; and a non-display area; and an electronic component corresponding to the second display area, wherein the display apparatus further comprises:

a plurality of first display elements at the first display area;

a plurality of first pixel circuits at the first display area, and corresponding to the plurality of first display elements, respectively;

a plurality of second display elements located at the second display area, and spaced from each other with the transmissive area therebetween;

a plurality of second pixel circuits located along a first direction, and adjacent to the plurality of first pixel circuits to be spaced apart from the plurality of second display elements in a plan view; and a data line electrically connected to one of the plurality of second pixel circuits, and to one of the plurality of first pixel circuits that is adjacent to the one of the plurality of second pixel circuits in a second direction crossing the first direction from among the plurality of first pixel circuits and located at the first display area.

12. The electronic device of claim 11, wherein a portion of the data line is located at the first display area.

13. The electronic device of claim 11, wherein the data line extends in the second direction.

14. The electronic device of claim 11, wherein the plurality of second pixel circuits is located along the first direction in rows.

15. The electronic device of claim 11, wherein the plurality of second pixel circuits is located at an area that is adjacent to the plurality of first pixel circuits.

16. The electronic device of claim 11, wherein at least one of the plurality of first pixel circuits and at least one of the plurality of first display elements overlap with each other.

17. The electronic device of claim 11, further comprising:

a plurality of first scan lines extending in the first direction at the first display area, and electrically connected to a plurality of rows of the plurality of first pixel circuits, respectively.

18. The electronic device of claim 11, further comprising a plurality of connection lines configured to electrically connect the plurality of second display elements to the plurality of second pixel circuits, respectively.

19. The electronic device of claim 18, wherein a portion of at least one of the connection lines comprises a transparent conductive oxide.

20. The electronic device of claim 18, wherein a portion of at least one of the connection lines is located at the second display area and extends in the first direction.

* * * * *